US010600287B2

(12) United States Patent
Sipaila et al.

(10) Patent No.: US 10,600,287 B2
(45) Date of Patent: Mar. 24, 2020

(54) GAMING SYSTEM AND METHOD PROVIDING PLAYS OF A CARD GAME WITH THE ABILITY TO SAVE CARDS FOR SUBSEQUENT PLAYS OF THE GAME

(71) Applicant: IGT, Las Vegas, NV (US)

(72) Inventors: James A. Sipaila, Reno, NV (US); Benjamin R. Holsclaw, Sparks, NV (US)

(73) Assignee: IGT, Las Vegas, NV (US)

( * ) Notice: Subject to any disclaimer, the term of this patent is extended or adjusted under 35 U.S.C. 154(b) by 582 days.

(21) Appl. No.: 14/305,593

(22) Filed: Jun. 16, 2014

(65) Prior Publication Data

US 2015/0364012 A1 Dec. 17, 2015

(51) Int. Cl.
*G07F 17/32* (2006.01)
*A63F 1/00* (2006.01)

(52) U.S. Cl.
CPC ..... *G07F 17/3293* (2013.01); *G07F 17/326* (2013.01); *G07F 17/3225* (2013.01); *A63F 1/00* (2013.01)

(58) Field of Classification Search
CPC ..... G07F 17/3293; A63F 1/00
See application file for complete search history.

(56) References Cited

U.S. PATENT DOCUMENTS 5,100,137 A 3/1992 Fulton et al.
5,167,413 A 12/1992 Fulton et al.
5,251,897 A 10/1993 Fulton et al.
5,322,295 A 6/1994 Cabot et al.
5,374,067 A 12/1994 Jones et al.
5,377,973 A 1/1995 Jones et al.
5,380,012 A 1/1995 Jones et al.
5,382,025 A 1/1995 Sklansky et al.
5,411,257 A 5/1995 Fulton et al.
5,431,408 A 7/1995 Adams et al.
5,437,451 A 8/1995 Fulton et al.
5,531,448 A 7/1996 Moody et al.
5,636,842 A 6/1997 Cabot et al.
5,732,950 A 3/1998 Moody et al.
5,755,621 A 5/1998 Marks et al.
5,803,809 A 9/1998 Yoseloff
5,820,460 A 10/1998 Fulton et al.
5,823,873 A 10/1998 Moody et al.
5,833,536 A 11/1998 Davids et al.
(Continued)

*Primary Examiner* — Pierre E Elisca
*Assistant Examiner* — Syvila Weatherford
(74) *Attorney, Agent, or Firm* — Neal, Gerber & Eisenberg LLP

(57) ABSTRACT

Various embodiments of the present disclosure are directed to a gaming system and method providing a card game wherein for a plurality of plays of the game, the gaming system enables the player to save cards for a subsequent play of the card game. In one embodiment, for a first play of the card game, the gaming system enables the player to select a first quantity of cards to save for a subsequent play of the game. In this embodiment, for a second play of the card game, the gaming system enables the player to use zero, one or more of the previously saved cards for the current play of the card game. The gaming system also enables the player to select new cards from a displayed second hand of cards to add to and/or replace any previously saved cards to save for a subsequent play of the game.

30 Claims, 21 Drawing Sheets

(56) References Cited

U.S. PATENT DOCUMENTS 5,833,537 A 11/1998 Barrie
5,882,259 A 3/1999 Holmes et al.
5,911,418 A 6/1999 Adams et al.
5,947,821 A 9/1999 Stone
5,954,335 A 9/1999 Moody et al.
5,957,774 A 9/1999 Holmes et al.
6,007,066 A 12/1999 Moody et al.
6,050,658 A 4/2000 O'Sullivan et al.
6,062,979 A 5/2000 Inoue
6,098,985 A 8/2000 Moody et al.
6,135,883 A 10/2000 Hachquet
6,176,781 B1 1/2001 Walker et al.
6,193,235 B1 2/2001 Vancura et al.
6,196,547 B1 3/2001 Pascal et al.
6,248,016 B1 6/2001 Walker et al.
6,257,979 B1 7/2001 Walker et al.
6,270,412 B1 8/2001 Crawford et al.
6,311,978 B1 11/2001 Moody
6,332,839 B2 12/2001 Walker et al.
6,334,613 B1 1/2002 Yoseloff
6,406,023 B1 6/2002 Rowe
6,419,578 B1 7/2002 Moody et al.
6,422,940 B1 7/2002 Walker et al.
6,474,645 B2 11/2002 Tarantino
6,494,454 B2 12/2002 Adams
6,517,074 B1 2/2003 Moody et al.
6,523,829 B1 2/2003 Walker et al.
6,533,273 B2 3/2003 Cole et al.
6,533,658 B1 3/2003 Walker et al.
6,561,898 B2 5/2003 Moody
6,568,680 B1 5/2003 Moody et al.
6,569,014 B2 5/2003 Walker et al.
6,592,456 B2 7/2003 Walker et al.
6,652,377 B1 11/2003 Moody
6,672,959 B2 1/2004 Moody et al.
6,726,427 B2 4/2004 Jarvis et al.
6,726,563 B1 4/2004 Baerlocher et al.
6,728,546 B1 * 4/2004 Peterson ..... H04M 1/2473 455/462
6,729,961 B1 5/2004 Millerschone
6,749,501 B2 6/2004 Crawford
6,916,245 B1 7/2005 Vancura et al.
6,935,950 B2 8/2005 Tarantino
6,949,454 B2 9/2005 Swanson et al.
6,955,356 B2 10/2005 Moody
6,964,418 B2 11/2005 Moody
6,969,316 B2 11/2005 Jarvis et al.
6,991,538 B2 1/2006 Cannon
6,994,624 B2 2/2006 Gold et al.
7,056,207 B2 6/2006 Walker et al.
7,059,965 B2 6/2006 Jackson
7,137,628 B2 11/2006 Moody
7,156,397 B2 1/2007 Moody et al.
7,156,734 B1 1/2007 Walker et al.
7,201,655 B2 4/2007 Walker et al.
7,222,857 B2 5/2007 Moody
7,222,858 B2 5/2007 Moody
7,223,172 B2 5/2007 Baerlocher et al.
7,247,092 B2 7/2007 Jarvis et al.
7,297,057 B2 11/2007 Gerrard et al.
7,322,887 B2 1/2008 Belger et al.
7,354,344 B2 4/2008 Paulsen et al.
7,387,568 B2 6/2008 Millerschone
7,390,258 B2 6/2008 Millerschone
7,393,276 B2 7/2008 Millerschone
7,404,762 B2 7/2008 Moody
7,416,186 B2 8/2008 Walker et al.
7,419,162 B2 9/2008 Lancaster et al.
7,431,644 B2 10/2008 Moody
7,467,542 B2 12/2008 Elrod
7,488,251 B2 2/2009 Kaminkow
7,524,243 B2 4/2009 Bansemer et al.
7,614,946 B2 11/2009 Nicely
7,641,197 B2 1/2010 Jackson
7,658,672 B1 2/2010 Wolf et al.
7,674,180 B2 3/2010 Graham et al.
7,740,533 B2 6/2010 Walker et al.
7,748,714 B2 7/2010 Nicely et al.
7,749,059 B2 7/2010 Tarantino
7,749,061 B2 7/2010 Walker et al.
7,771,274 B2 8/2010 Walker et al.
7,775,877 B2 8/2010 Baerlocher et al.
7,785,188 B2 8/2010 Cannon
7,785,196 B2 8/2010 Baerlocher et al.
7,789,755 B2 9/2010 Davis et al.
7,794,324 B2 9/2010 White et al.
7,803,041 B2 9/2010 Gold et al.
7,803,043 B2 9/2010 Jackson
7,815,500 B2 10/2010 Montross et al.
7,837,545 B2 11/2010 Blair, Jr. et al.
7,857,693 B1 12/2010 Johnson et al.
7,862,417 B2 1/2011 Nicely
7,862,430 B2 1/2011 Baerlocher et al.
7,867,073 B2 1/2011 Walker et al.
7,914,369 B2 3/2011 Walker et al.
7,918,724 B2 4/2011 Walker et al.
7,922,571 B2 4/2011 Walker et al.
7,985,133 B2 7/2011 Baerlocher et al.
7,993,191 B2 8/2011 Evans et al.
7,993,195 B2 8/2011 Belger et al.
7,993,199 B2 8/2011 Iddings et al.
8,002,620 B2 8/2011 Nicely et al.
8,012,009 B2 9/2011 Iddings et al.
8,062,119 B2 11/2011 Stern et al.
8,083,578 B2 12/2011 Jackson
RE43,114 E 1/2012 Walker et al.
8,092,290 B2 1/2012 Darby
8,092,291 B2 1/2012 Gerrard et al.
8,092,302 B2 1/2012 Cuddy et al.
8,100,748 B2 1/2012 Montross et al.
8,123,604 B2 2/2012 Lancaster et al.
8,137,174 B2 3/2012 Nicely et al.
8,142,280 B2 3/2012 Walker et al.
8,147,310 B2 4/2012 Jarvis et al.
8,152,615 B2 4/2012 Lancaster et al.
8,152,630 B2 4/2012 Cohen
8,157,631 B2 4/2012 Lancaster et al.
8,172,660 B2 5/2012 Lancaster et al.
8,177,616 B2 5/2012 Nicely
8,177,619 B2 5/2012 Jackson
8,197,319 B2 6/2012 Nicely
8,197,321 B2 6/2012 Wolf et al.
8,206,212 B2 6/2012 Iddings et al.
8,210,532 B2 7/2012 Evans et al.
8,210,533 B2 7/2012 Evans et al.
8,210,930 B2 7/2012 Graham et al.
8,216,039 B2 7/2012 Nicely et al.
8,216,042 B2 7/2012 Crawford, Jr. et al.
8,216,062 B2 7/2012 Baerlocher et al.
8,221,226 B2 7/2012 Baerlocher et al.
8,226,469 B2 7/2012 Pawloski et al.
8,231,454 B2 7/2012 Caputo
8,235,780 B2 8/2012 Nicely
8,235,781 B2 8/2012 Moody
8,241,108 B2 8/2012 Belger et al.
8,246,449 B2 8/2012 Baerlocher et al.
8,257,163 B2 9/2012 Belger et al.
8,262,448 B2 9/2012 Nicely et al.
8,262,469 B2 9/2012 Iddings et al.
RE43,822 E 11/2012 Walker et al.
8,328,614 B2 12/2012 Jones et al.
8,328,623 B2 12/2012 Stern et al.
8,338,437 B2 12/2012 Wahhab et al.
8,342,958 B2 1/2013 Cuddy et al.
8,353,751 B2 1/2013 Bickley et al.
8,376,836 B2 2/2013 Baerlocher et al.
8,382,572 B2 2/2013 Hoffman et al.
8,393,958 B2 3/2013 Cohen
8,398,472 B2 3/2013 Bansemer et al.
8,398,473 B2 3/2013 Baerlocher et al.
8,403,739 B2 3/2013 Jackson
8,408,984 B2 4/2013 Walker et al.
8,414,379 B2 4/2013 Nicely et al.
8,419,518 B2 4/2013 Jarvis et al.

(56) References Cited

U.S. PATENT DOCUMENTS 8,425,303 B2 4/2013 Kennedy et al.
8,434,764 B2 5/2013 Walker et al.
8,444,465 B2 5/2013 Macaulay
8,449,362 B2 5/2013 Jackson
8,449,363 B2 5/2013 Baerlocher et al.
8,449,364 B2 5/2013 Lancaster et al.
8,449,378 B2 5/2013 Michaelson et al.
8,454,429 B2 6/2013 Jaffe et al.
8,475,253 B1 * 7/2013 Cole ..... G07F 17/3262 273/138.1
8,475,255 B2 7/2013 Wolf et al.
8,485,880 B2 7/2013 Nicely
8,491,381 B2 7/2013 Nicely et al.
8,500,542 B2 8/2013 Baerlocher et al.
8,500,551 B2 8/2013 Baerlocher et al.
8,506,338 B2 8/2013 Gallato et al.
8,512,138 B2 8/2013 Saunders
8,517,818 B2 8/2013 Nicely et al.
2002/0068620 A1 * 6/2002 Stern ..... A63F 3/0645 463/13
2006/0068893 A1 3/2006 Jaffe et al.
2006/0105828 A1 * 5/2006 Fitzgerald ..... A63F 3/00157 463/13
2006/0287033 A1 * 12/2006 Rozkin ..... G07F 17/3293 463/13
2007/0060236 A1 * 3/2007 Dodge ..... G07F 17/32 463/11
2007/0126180 A1 * 6/2007 Dodge ..... G07F 17/32 273/292
2008/0076542 A1 3/2008 Iddings et al.
2008/0111309 A1 5/2008 Nicely et al.
2008/0188278 A1 8/2008 Paulsen et al.
2008/0254847 A1 10/2008 Millerschone
2010/0004051 A1 1/2010 Walker et al.
2010/0081497 A1 4/2010 Wolf et al.
2010/0099480 A1 4/2010 Caputo
2010/0113122 A1 5/2010 Walker et al.
2010/0120484 A1 5/2010 Caputo et al.
2010/0137056 A1 6/2010 Hoffman et al.
2010/0227661 A1 9/2010 Walker et al.
2011/0003627 A1 1/2011 Nicely et al.
2011/0014963 A1 1/2011 Walker et al.
2011/0111818 A1 5/2011 Baerlocher
2012/0122534 A1 5/2012 Montross et al.
2012/0149451 A1 6/2012 Nicely et al.
2012/0214580 A1 8/2012 Hoffman et al.
2012/0270622 A1 10/2012 Pawloski et al.
2012/0270641 A1 10/2012 Baerlocher et al.
2012/0276971 A1 11/2012 Nicely et al.
2012/0282996 A1 11/2012 Nicely et al.
2012/0295683 A1 11/2012 Moody
2012/0329543 A1 12/2012 Nicely et al.
2013/0040721 A1 2/2013 Belger et al.
2013/0065669 A1 3/2013 Michaelson et al.
2013/0079110 A1 3/2013 Nicely et al.
2013/0079123 A1 3/2013 Nicely et al.
2013/0084961 A1 4/2013 Radisich et al.
2013/0084962 A1 4/2013 Radisich et al.
2013/0084994 A1 4/2013 Farrar
2013/0095918 A1 4/2013 Cuddy et al.
2013/0150152 A1 6/2013 Cohen
2013/0172064 A1 7/2013 Bansemer et al.
2013/0172065 A1 7/2013 Jackson
2013/0172067 A1 7/2013 Hoffman et al.
2013/0196748 A1 8/2013 Nicely et al.
2013/0203478 A1 8/2013 Kennedy et al.
2013/0217457 A1 8/2013 Jarvis et al.
2013/0231170 A1 9/2013 Macaulay
2013/0231176 A1 9/2013 Walker et al.

* cited by examiner

GAMING SYSTEM AND METHOD PROVIDING PLAYS OF A CARD GAME WITH THE ABILITY TO SAVE CARDS FOR SUBSEQUENT PLAYS OF THE GAME

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

In recent years, poker has become very popular. One of the most common variations of poker is Five Card Draw. In general, in Five Card Draw poker the player receives five cards dealt face up from a fifty-two card deck of playing cards. The player can discard none, one, a plurality, or all of the five cards. Each discarded card is replaced with another card from the deck. After the replacement (if any), the cards are evaluated for winning combinations. For a five-card poker game, there are typically ten general categories of hands, ranked from highest to lowest, as shown in Table 1 below.

TABLE 1

Ranking of Five Card Poker Hands by Category

| Rank | Name | Example |
|---|---|---|
| 1 | Royal Straight Flush | A♣K♣Q♣J♣10♣ |
| 2 | Straight Flush | K♣Q♣J♣10♣9♣ |
| 3 | Four of a Kind | J♣J♥ J♦ J♠3♣ |
| 4 | Full House | A♥ A♦ A♣6♦ 6♣ |
| 5 | Flush | A♣J♣8♣6♣2♣ |
| 6 | Straight | 8♦ 7♣6♠5♠4♣ |
| 7 | Three of a Kind | Q♠Q♥ Q♦ 6♦ 2♠ |
| 8 | Two Pair | 8♦ 8♥ 5♥ 5♣2♠ |
| 9 | One Pair | K♦ K♠8♣7♣2♥ |
| 10 | High Card | A♥ 10♣7♦ 5♠3♠ |

Within each category, hands are ranked according to the rank of individual cards, with an Ace being the highest card and a Two being the lowest card. There is no difference in rank between the four suits of cards. All hands can be ranked in a linear ranking from highest to lowest. Because suits are all of the same value, however, there are multiple hands that have identical rankings. For example, there are four equivalent hands for each type of Straight Flush, Four of a Kind, or Flush. There are over a hundred equivalent hands for each Two Pair variation, and there are over 1,000 equivalent hands for each type of no-pair hand.

Numerous variations of poker exist, including Five Card Draw as mentioned above, Three Card Poker, Five Card Stud, Seven Card Stud, Hold 'Em (also called Texas Hold 'Em), Omaha (also called Omaha Hold 'Em), and Pai-Gow Poker. These games generally differ in the manner in which cards are dealt and in the manner and frequency in which bets are placed. Various criteria may also be used to determine the winning hand, including the highest ranking hand, the lowest ranking hand (Low-Ball), and where the highest ranking and lowest ranking hands each win half of the pot (High-Low).

In certain known multiplayer variations of poker, players play against each other rather than against a dealer or house. In certain of these variations, a round of play begins when each player has placed an initial bet, which is typically referred to as the ante, into the pot. The term pot typically refers to the total accumulation of antes and wagers made during a particular game. In other poker variations, such as Texas Hold 'Em (described in further detail below), only two players at a table make the initial bets, which are commonly referred to as the blinds.

The quantity of cards dealt depends on the particular variation of poker being played. For example, in Five Card Draw, each player is initially dealt five cards. In typical Three Card Poker games where the player plays against a dealer hand, the player is dealt a total of three cards and the dealer hand includes a total of three cards as well. In certain known Three Card Poker games, the initially dealt player hand and dealer hand are final and there is no option to replace or draw any new cards. In Texas Hold 'Em, Five Card Stud and Seven Card Stud, each player is initially dealt two cards. These cards are typically dealt face-down. However, depending on the game, some of the cards may be dealt face-up to the player. For example, in certain versions of Five Card Stud, each player is initially dealt one card face-up and one card face-down. In Texas Hold 'Em, each player is initially dealt two cards face-down, which are commonly referred to as the hole cards.

For certain poker variations in which additional cards are dealt or in which cards may be replaced, after the initial deal, a first round of wagering begins, in which the players have the opportunity to place wagers. If a player places a wager, that wager must be matched (i.e., called) or raised by each player that wants to remain in the game. A raise includes matching the previous wager and increasing the total bet. A player who does not match a bet drops out of the game or folds. A round of betting ends when either every player but one has folded, or when the highest bet or raise has been called by at least one remaining player such that each remaining player has wagered the same amount into the pot during the round.

Depending on the variation of poker being played, each game may have only an initial wager or several rounds of wagering, where each round of wagering is generally preceded by the dealing of one or more cards. A player wins a game of poker by being the last remaining player in the game after all other players have folded or by having the highest ranking hand when a showdown occurs. If two or more players remain after the final round of wagering is complete, a showdown occurs. During the showdown, each remaining player's hand is displayed, the highest ranking hand is determined to be the winning hand, and the pot is provided to the player having the winning hand. If two or more players have identically ranked hands that are the highest ranking hands, the pot is split evenly among the tying players.

Of the poker variations mentioned above, Texas Hold 'Em is one of the more popular versions. Texas Hold 'Em is generally a multi-player card game played at a live card table or via a computer-based virtual card table. In one version of a live card table game of Texas Hold 'Em, only two players at a table make the initial bets, commonly referred to as the blinds. The blinds include a big blind and a small blind. The big blind is typically twice the value of the small blind. In a blind-based game such as Texas Hold 'Em, all players are initially eligible to receive a hand, even if they do not place the big blind or the small blind. After the players have anted (if an ante is required), each player eligible for play is dealt an initial set of cards. Each of the players must match the blinds, raise the blinds or fold. Texas Hold 'Em includes a designated quantity of community cards (usually five) that can be used by all of the players in combination with their hole cards. However, in certain variations, there may only be three community cards. In certain Texas Hold 'Em games, the community cards are dealt over the course of several wagering rounds. For example, the gaming device or dealer deals the flop (usually three cards), the turn (usually one card), and the river (usually one card). The winning hand is the resulting five card hand (of the combined seven cards) having the highest poker rank. This method of determining a winning five card hand is similar to determining a winning hand in Seven Card Stud. However, Seven Card Stud does not utilize community cards as in Texas Hold 'Em. In other variations of Texas Hold 'Em, where the quantity of community cards is only three, the flop is a single card rather than three cards.

There is a continuing need for new and exciting poker games to keep players engaged during game play, increase entertainment value, and provide additional excitement to players.

SUMMARY

Various embodiments of the present disclosure are directed to a gaming system and method providing a card game wherein for a plurality of plays of the game, the gaming system enables the player to hold one or more cards of a hand of cards for a subsequent play of the card game.

In various embodiments, for a plurality of plays of a card game, the gaming system enables a player to save up to a designated quantity of cards for a subsequent play of the game. In one embodiment, for a first play of the card game, the gaming system randomly selects and displays a first hand of cards from a virtual deck of cards. The gaming system enables the player to select a first quantity of up to the designated quantity of cards to set aside, or save, for a subsequent play of the game. The designated quantity represents the quantity of cards that the gaming system enables the player to save for each play of the game. The gaming system then completes the first play of the game, determines the game outcome, and displays any award associated with the determined game outcome. For a second play of the card game, the gaming system randomly selects and displays a second hand of cards from a virtual deck of cards. In this embodiment, since the player saved the first quantity of cards from a previous play of the game, the gaming system enables the player to use zero, one or more of the previously saved cards for the current play of the card game. The gaming system also enables the player to select new cards from the second hand of cards to save for a subsequent play of the game. For any newly selected cards, the gaming system enables the player to add to and/or replace any remaining previously saved cards, wherein the quantity of total saved cards for the play of the game is less than or equal to the designated quantity of cards. The gaming system then completes the second play of the game, determines the game outcome and displays any award associated with the determined game outcome. It should be appreciated that through such a configuration, the gaming system provides multiple opportunities for the player to improve both a current hand and a future displayed hand of cards to obtain a winning card combination.

More specifically, in one example, the card game is a draw poker card game. For a first play of the card game, the gaming system randomly selects and displays a first hand of five cards. In this example, prior to the draw phase, the gaming system enables the player to select a first quantity of up to a designated quantity of three cards to save for a subsequent play of the game. For a first play of the game, there are no saved cards from a previous play of the game. Thus, the gaming system enables the player to select zero, one, two, or three cards to save for a subsequent play of the game. The gaming system then enables the player to select zero, one, or a plurality of the remaining cards to hold for the current play of the game. The gaming system then discards any remaining unselected cards, and provides replacement cards to complete a final first hand of five cards. The gaming system determines a game outcome, and provides any awards associated with the determined game outcome.

In this example, for a second play of the card game, the gaming system randomly selects and displays a second hand of five cards from a virtual deck of cards. For the second play of the game, the gaming system enables the player to use zero, one or more of any cards saved from the previous play of the game for the current play of the game. Additionally, the gaming system enables the player to save additional cards and/or replace previously saved cards with new cards from the second hand of cards, wherein the total quantity of saved cards does not exceed the designated quantity of three cards. In this example, the player currently has two cards saved from a previous play of the game.

If the player selects zero of the previously saved cards from the first play of the game to use in the second play of the game, the gaming system enables the player to: (1) select one card from the second hand of cards to add to the previously saved cards and save for a subsequent play of the game; and (2) select up to two cards from the second hand of cards to replace any of the previously saved cards to save for a subsequent play of the game.

If, on the other hand, the player selects one of the two previously saved cards from the first play of the game to use in the second play of the game, the gaming system enables the player to select one card from the second hand of cards to remove from the second hand of cards. In this example, the gaming system enables the player to have a maximum of five cards for each hand of cards. Thus, the gaming system enables the player to remove one of the cards from the second hand of cards to make space for the previously saved card. More specifically, the gaming system enables the player to: (1) select one card from the second hand of cards to swap with the previously saved card so as to save the newly selected card from the second hand of cards for a subsequent play of the game; or (2) select one card from the second hand of cards to discard from the second hand of cards. The gaming system also enables the player to select additional cards from the second hand of cards to add to and/or replace any cards saved for a subsequent play of the game, wherein the total quantity of saved cards is less than or equal to the designated quantity of three cards.

If, instead, the player selects to use both of the saved cards from the first play of the game in the second play of the game, the gaming system enables the player to select two cards from the second hand of cards to remove from the second hand of cards. More specifically, the gaming system enables the player to: (1) select zero, one or two cards from the second hand of cards to swap with the previously saved cards so as to save the newly selected cards from the second hand of cards for a subsequent play of the game; and (2) select zero, one or two cards from the second hand of cards to discard from the second hand of cards. The gaming system also enables the player to select additional cards to add to and/or replace any cards saved for a subsequent play of the game, wherein the total quantity of saved cards is less than or equal to the designated quantity of cards.

The gaming system then completes the second play of the game. To complete the second play of the game, the gaming system enables the player to select zero, one, or a plurality of cards of the remaining cards of the second hand of cards to hold for the second play of the card game. The gaming system holds any cards selected to be held for the current play of the game, discards any unselected cards, and provides replacement cards to complete the final second hand of cards. The gaming system determines a game outcome for the second play of the game and provides any awards associated with the determined game outcome.

Thus, for a play of the game, the gaming system enables the player to improve future and current hands of cards by enabling the player to: (1) save one or more cards for a subsequent play of the game, and (2) use one or more saved cards from a previous play of the game to improve a current hand of cards.

It should be appreciated that in this embodiment, the gaming system enables the player to select an unlimited quantity of cards to save and an unlimited quantity of saved cards to include in the play of the game.

The present disclosure thus provides a new and exciting card game that keeps players engaged during game play, increases entertainment value, and provides additional player excitement.

Additional features and advantages are described herein, and will be apparent from, the following Detailed Description and the Figures.

DETAILED DESCRIPTION

Card Game with the Ability to Save Cards

Various embodiments of the present disclosure are directed to a gaming system and method providing a card game with the ability to save one or more cards for a subsequent play of the game. In various embodiments, for a plurality of plays of the card game, the gaming system enables the player to save up to a designated quantity of cards for a subsequent play of the game. For a first play of the card game, the gaming system enables the player to save up to the designated quantity of cards for a subsequent play of the game. For a second play of the card game, the gaming system enables the player to use any cards saved from a previous play of the game for a current play of the game. The gaming system additionally enables the player to add to and/or replace any saved cards from the previous play of the card game with displayed cards from the current play of the card game. Thus, the configuration of the present disclosure enables the player to improve current and future hands by providing the ability to save cards for a subsequent play of the game.

While the card game of the present disclosure is employed as a base or primary game in the embodiments described below, it should be appreciated that the card game may additionally or alternatively be employed as or in association with a bonus game or a secondary game. Moreover, while any credit balances, any wagers, and any awards are displayed as amounts of monetary currency, credits, or "chips" representing monetary currency or credits in the embodiments described below, one or more of such credit balances, such wagers, and such awards may be for non-monetary credits, promotional credits, player tracking points or credits, or chips representing any thereof.

In certain of the example embodiments described below, while the example card games are variations of draw poker games, it should be appreciated that the present disclosure contemplates employing any other suitable type of card game instead of or in addition to draw poker games.

Figure 1A:
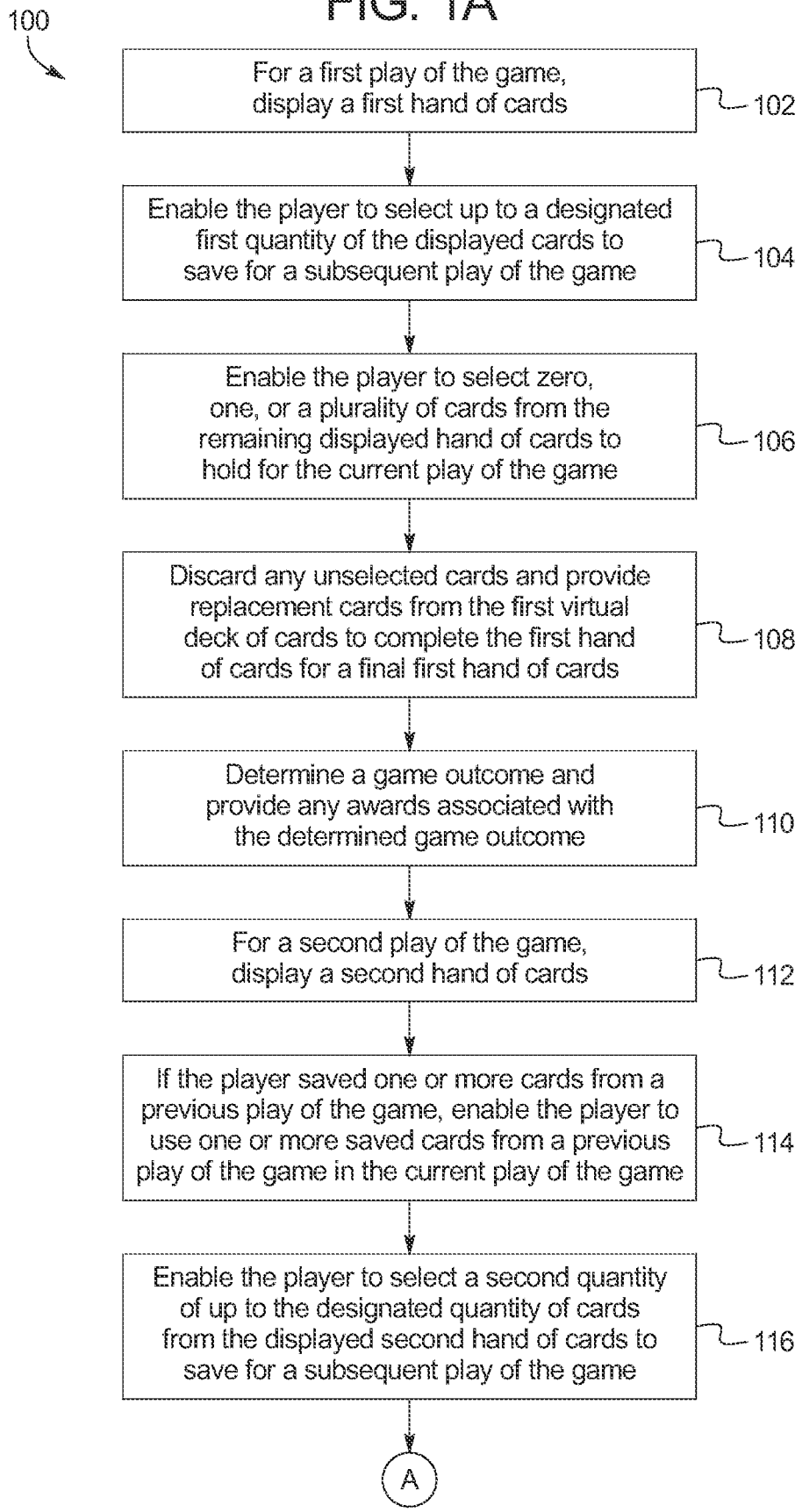
FIGS. 1A and 1B (collectively FIG. 1) are flowcharts illustrating a method of operating an example embodiment of the gaming system of the present disclosure configured to operate the card game wherein two or more cards of a hand of cards are combinable to form a resultant card with a higher combined value.
Figure 1B:
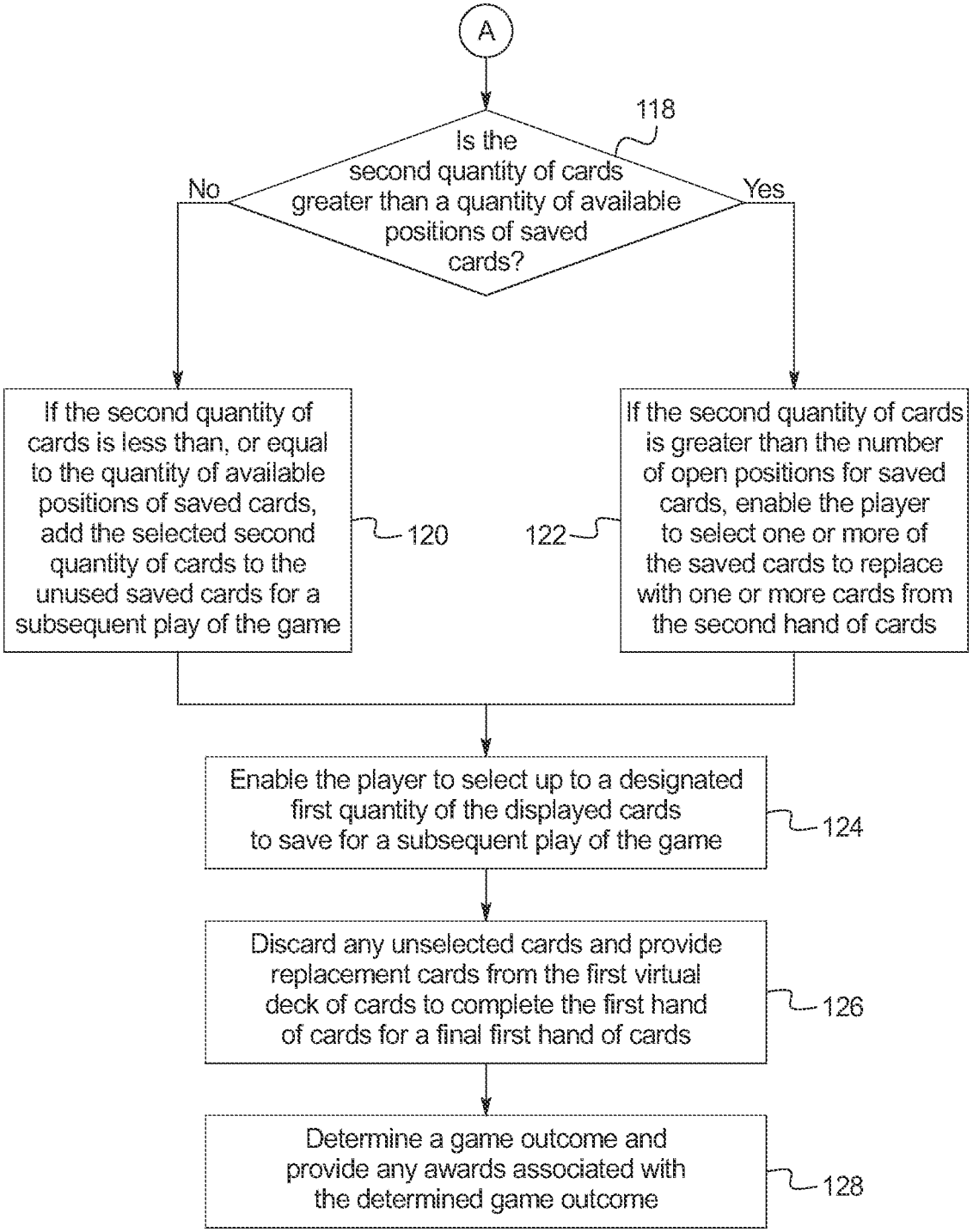

Referring now to FIGS. 1A and 1B (referred to collectively as FIG. 1), which illustrate a flowchart of an embodiment of a process for operating a gaming system disclosed herein. In one embodiment, this process is embodied in one or more software programs stored in one or more memories and executed by one or more processors or servers. Although this process is described with reference to the flowchart illustrated in FIG. 1, it should be appreciated that many other methods of performing the acts associated with this process may be used. For example, the order of certain of the illustrated blocks and/or diamonds may be changed, certain of the illustrated blocks and/or diamonds may be optional, and/or certain of the illustrated blocks and/or diamonds may not be employed.

In operation of this embodiment, the gaming system provides a plurality of plays of a draw poker card game. For a first play of the game, as indicated by block 102, the gaming system randomly selects and displays a first hand of five cards from a first virtual deck of 52 cards. In this embodiment, the gaming system also separately displays a designated quantity of saved card positions. The designated quantity is the quantity of total cards the gaming system enables a player to save for a subsequent play of the game. In this embodiment, the designated quantity is three cards. For the first play of the game, there are no previously saved cards in the saved card positions. Thus, all three of the saved card positions are available for newly selected saved cards.

After displaying the first hand of five cards, as indicated by block 104, the gaming system enables the player to select a first quantity of up to the designated quantity of the displayed cards to save for a subsequent play of the game. Thus, in this example, the gaming system enables the player to select zero, one, two, or three of the displayed cards from the first hand of cards to save for a subsequent play of the game. In this embodiment, the gaming system removes any cards selected to be saved for a subsequent play of the game from the displayed first hand of cards and moves the saved cards to the saved card display area.

It should be appreciated that in this embodiment, the subsequent play of the game refers to any play of the game occurring after the current play of the game from which the player selects the saved cards. More specifically, in this embodiment, the subsequent play of the game refers to a subsequent coin-in event. In certain alternative embodiments, as will be discussed in greater detail below, a single wager funds a plurality of hands and the gaming system enables the player to hold one or more cards for a subsequent hand of cards.

Once the player selects the first quantity of cards from the displayed first hand of cards to save for a subsequent play of the game, the gaming system enables the player to select zero, one, or a plurality of the remaining unselected cards from the displayed hand of cards to hold for the current play of the game, as indicated by block 106.

After the player selects any cards to hold for the current play of the game, the gaming system discards any unselected cards, and provides replacement cards from the first virtual deck of cards to complete the first hand of cards for a final first hand of cards, as indicated by block 108.

The gaming system determines a game outcome for the first hand of cards and provides any awards associated with the determined game outcome, as indicated by block 110. More specifically, the gaming system determines whether the final hand of cards includes any winning card combinations. If the final hand of cards includes any winning card combinations, the gaming system determines any award associated with the winning card combinations. In this example, the gaming system uses a standard five-card Jacks or Better paytable to determine whether the final hand of cards includes any winning card combination and to determine any award associated with any winning card combination.

For a second play of the game, in this embodiment, the gaming system displays the cards saved from the previous play of the game. As indicated by block 112, the gaming system randomly selects and displays a second hand of cards from the first virtual deck of cards minus any cards saved from the previous play of the game. For example, if in the first play of the game, the player saved three cards, in this example the gaming system selects the second hand of cards from the first virtual deck of 49 cards (i.e., 52 cards minus the three cards saved from the first hand of cards).

In this embodiment, as indicated by block 114, the gaming system enables the player to select zero, one or more of the saved cards from the previous play of the game to use for the current play of the game. It should be appreciated that in this embodiment, the gaming system enables the player to select, zero, one or a plurality of the saved cards. In certain alternative embodiments, as described in greater detail below, the gaming system does not enable the player to select less than the total quantity of saved cards from the previous play of the game. Thus, in an example of the alternative embodiment, the gaming system enables the player select all or none of the cards saved from the previous play of the game for a current play of the game.

The gaming system also enables the player to select a second quantity, of cards from the displayed second hand of cards to save for a subsequent play of the game, as indicated by block 116. If the player selects a second quantity of cards to save for a subsequent play of the game, the gaming system determines whether the second quantity of cards is greater than the quantity of available saved card positions, as indicated by diamond 118. The quantity of available saved card positions is the designated quantity of saved cards (three cards) minus the quantity of any unused saved cards from a previous play of the game.

In this embodiment, as indicated by block 120, if the gaming system determines that the quantity of available saved card positions is less than or equal to the available saved card positions, then there are sufficient available saved card positions for each card selected to be saved from the current play of the game. The gaming system adds the selected second quantity of cards to any unused previously saved cards. On the other hand, if the gaming system determines that the second quantity of cards is greater than the number of open positions for saved cards, there are not sufficient available saved card positions for each card selected to be saved from the current play of the game. The gaming system enables the player to select one or more of the saved cards to replace with one or more cards from the second hand of cards, as indicated by block 122.

In one example of this embodiment, the gaming system enables a player a player to save zero cards in the first play of the game. In this example, for a second play of the game, there are no previously saved cards and the designated quantity of saved cards is three cards. Thus, the gaming system enables the player to select zero, one, two, or three cards to add to the saved card positions to save for a subsequent play of the game.

In another example of this embodiment, the gaming system enables a player to save one card in the first play of the game. In this example, for a second play of the game, there is one previously saved card and the designated quantity of saved cards is three cards. Thus, the gaming system enables the player to use zero or one of the previously saved cards for the currently play of the game. The gaming system additionally enables the player to: (1) select zero, one, or two of the displayed cards from the second hand of the game to add to the saved card positions; and (2) select zero or one card to replace the previously saved card.

It should be appreciated that in this embodiment, the gaming system provides a maximum of five cards for each displayed hand of cards. Thus, for each of the previously saved cards that are selected to be used in the current hand, the gaming system enables the player to remove a displayed card from the current hand of cards. More specifically, for each previously saved card used in the current hand of cards, the gaming system enables the player to: (1) select a card from the currently displayed hand of cards to swap with the previously saved card thereby saving the new card for a subsequent play of the game, or (2) select one card from the currently displayed hand of cards to discard.

In a third example of this embodiment, the gaming system enables a player to save two cards in the first play of the game. In this example, for a second play of the game, there are two previously saved cards and the designated quantity of saved cards is three cards. Thus, the gaming system enables the player to use zero, one, or two of the previously saved cards for the second play of the game. The gaming system additionally enables the player to: (1) select zero, or one of the displayed cards from the second hand of the game to add to the saved card positions; and (2) select zero, one or two cards to replace any of the previously saved cards.

In a fourth example of this embodiment, a gaming system enables a player to save three cards in the first play of the game, which is equal to the designated quantity of saved cards. In this example, for a second play of the game, there are three previously saved cards. Thus, the gaming system enables the player to use zero, one, two, or three of the previously saved cards for the second play of the game. The gaming system does not enable the player to add any of the displayed cards from the second hand of the game to the saved card positions because there are no available saved card positions. The gaming system enables the player to select zero, one, two, or three cards to replace any of the previously saved cards.

After selecting any cards to use in the current play of the game, and selecting any cards to save for the subsequent play of the game, the gaming system completes the second play of the game. The gaming system enables the player to select zero, one, or a plurality of the remaining unselected displayed cards to hold for the current play of the game, as indicated by block 124. After the player selects any cards to hold for the current play of the game, the gaming system: (1) moves any saved cards selected to be used in the current play of the game to the displayed second hand of cards; (2) removes any cards selected to be saved for a subsequent play of the game from the displayed second hand of cards to the saved card display area; (3) holds any cards selected to be held for the current play of the game; (4) discards any unselected cards; and (4) provides replacement cards from the first virtual deck of cards to complete the second hand of cards for a final second hand of cards, as indicated by block 126. It should be appreciated that in this embodiment, the gaming system provides a maximum of five displayed cards for each hand of cards. Thus, if the player selects to use any previously saved cards, the gaming system enables the player to select one or more of the cards from the current hand of cards to remove.

It should also be appreciated that in this embodiment, the gaming system provides replacement cards for all card including those cards saved for a subsequent play of the game and those cards discarded during the draw phase. In certain alternative embodiments, as will be described in greater detail below, the gaming system does not provide replacement cards for any saved cards.

The gaming system then determines a game outcome for the second hand of cards and provides any awards associated with the determined game outcome, as indicated by block 128.

It should be appreciated that for each play of the card game, the gaming system enables the player to improve the current and/or future hand of cards by saving cards for subsequent play of the game. Thus, the gaming system provides the player multiple opportunities to obtain a winning hand. As such, the present disclosure provides a game that keeps players excited and engaged.

Turning now to FIGS. 2A to 2E, which illustrate screen shots of one example embodiment of the gaming system of the present disclosure operating a card game with the ability to save cards for a subsequent play of the game, as described above with respect to FIG. 1. In this example embodiment, the gaming system displays: (a) a plurality of meters including: (i) a credit meter 202 that displays the player's credit balance (in credit or currency form), (ii) a wager or bet meter 204 that displays any wager or bet placed on a play of the game (in credit or currency form), and (iii) an award meter 206 that displays any awards won for the play of the game (in credit or currency form); and (b) a message box 250 that displays a variety of messages or indications before, during, or after play of the game.

FIGS. 2A to 2E illustrate the first play of a plurality of plays of a game for one example embodiment. The gaming system of this example employs a draw poker card game.

Figure 2A:
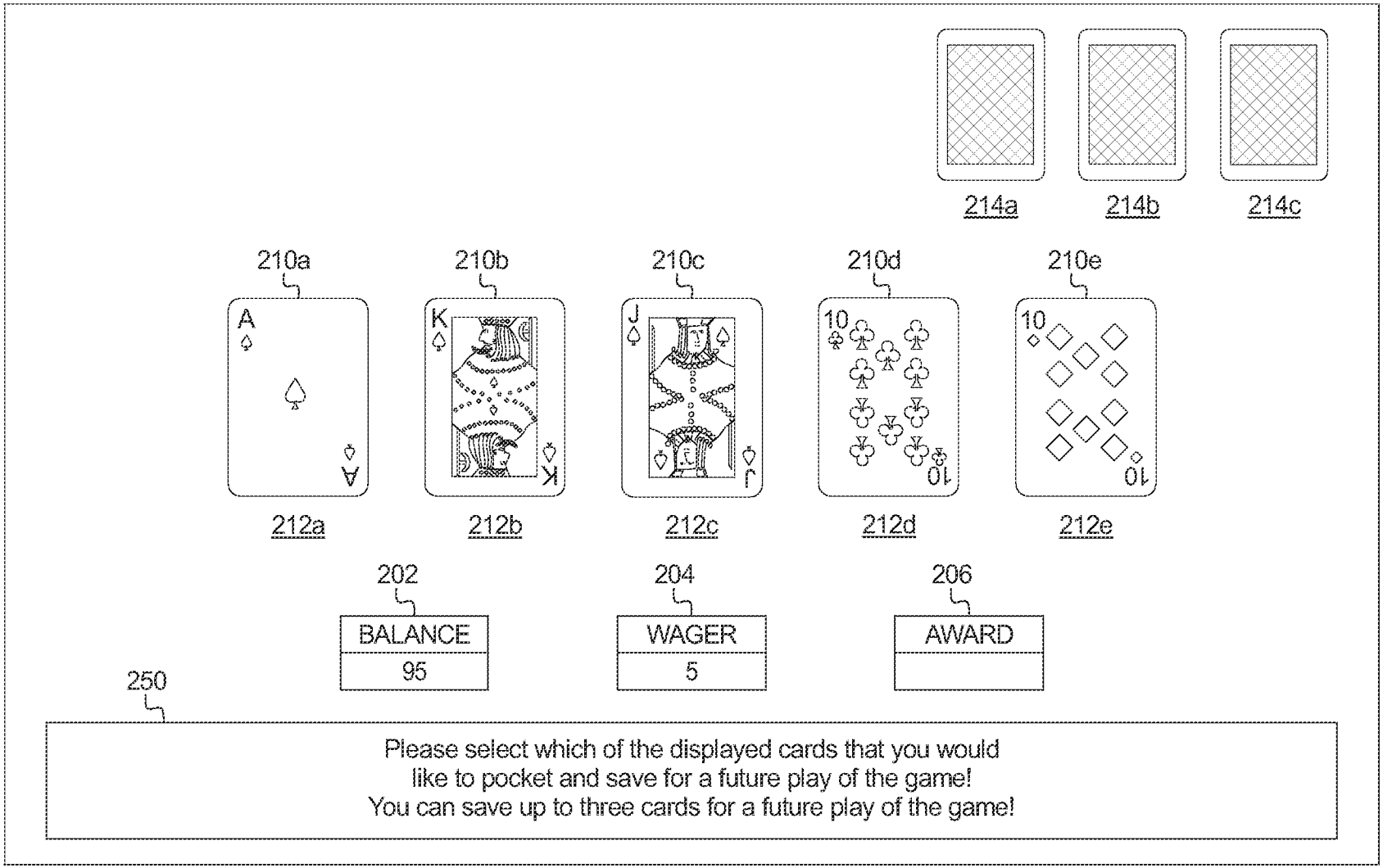
FIGS. 2A, 2B, 2C, 2D, and 2E illustrate screen shots of an example of one embodiment of the gaming system of the present disclosure providing a plurality of plays of a game, wherein the gaming system enables the player to hold one or more cards for a subsequent play of the game according to the method of FIG. 1.

Turning to FIG. 2A, in this embodiment, for a first play of the game, the gaming system randomly selects a first hand of cards 210 including five cards 210*a*, 210*b*, 210*c*, 210*d*, and 210*e* from a virtual deck of 52 cards and displays the first hand of cards 210 face up as shown at positions 212*a*, 212*b*, 212*c*, 212*d*, and 212*e*. More specifically, in this example, the gaming system displays the first hand of cards including the: A♠, K♠, J♠, 10♣, and 10♦ as indicated by 210*a*, 210*b*, 210*c*, 210*d* and 210*e*. In this example, the gaming system enables the player to save up to a designated quantity of three cards for a subsequent play of the game. The designated quantity is the total quantity of cards that the gaming system enables a player to save for a subsequent play of the game. In this example, the designated quantity of three possible saved cards is illustrated by the saved card positions 214*a*, 214*b*, and 214*c*. For the first play of the game, there are no cards saved from a previous play of the game, thus all three saved card positions are available.

The gaming system enables the player to select a first quantity of up to the designated quantity of cards from the displayed first hand of cards 210 to save for a subsequent play of the game. After displaying the first hand of cards, the gaming system displays the following message in the message box 250: "PLEASE SELECT WHICH OF THE DISPLAYED CARDS THAT YOU WOULD LIKE TO POCKET AND SAVE FOR A FUTURE PLAY OF THE GAME! YOU CAN SAVE UP TO THREE CARDS FOR A FUTURE PLAY OF THE GAME!"

Figure 2B:
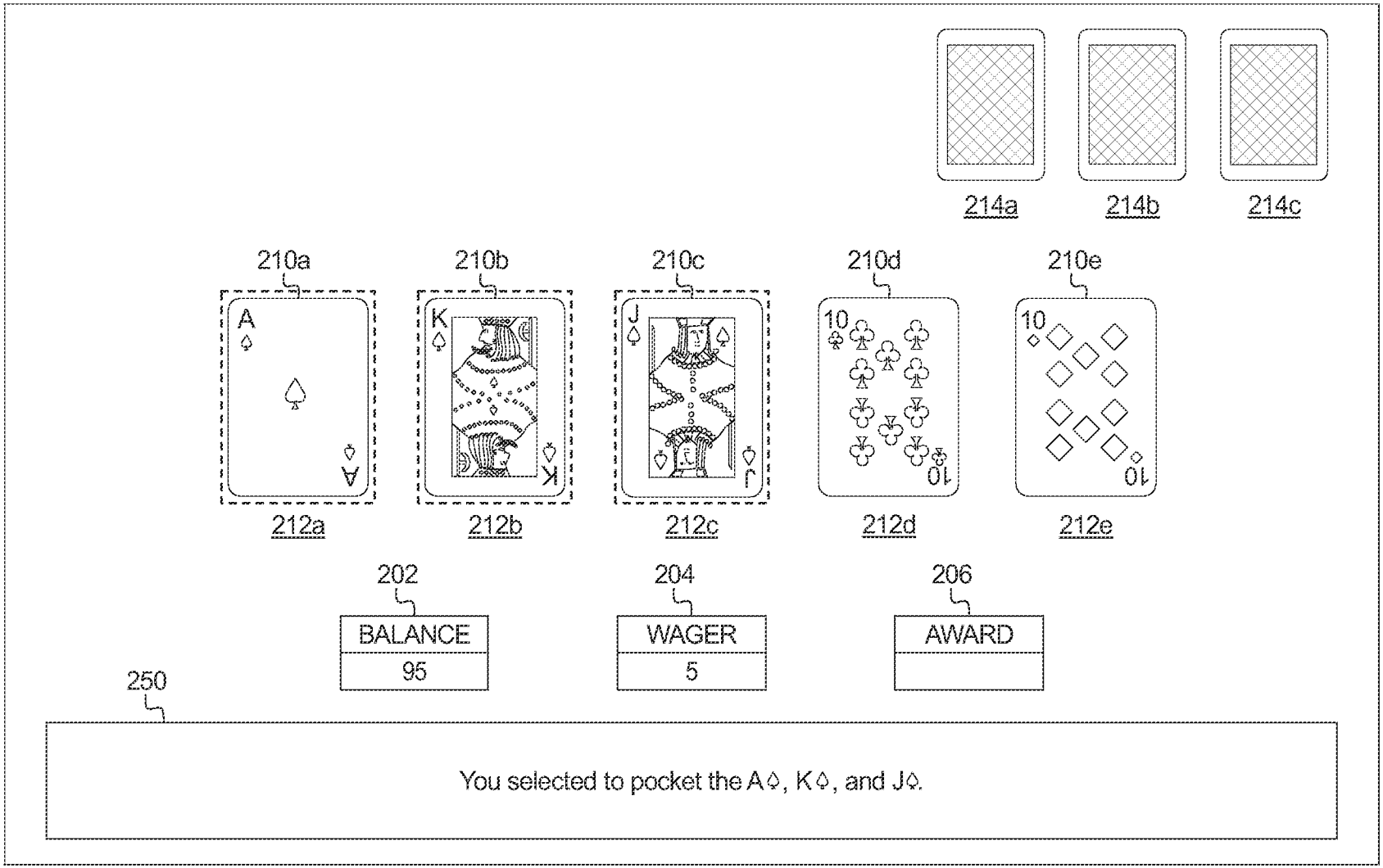

As illustrated in FIG. 2B, the player selects three cards to save for a subsequent play of the game, A♠, K♠, and J♠ as indicated by 210*a*, 210*b*, and 210*c*. The gaming system displays the following message in the message box 250: "YOU SELECTED TO POCKET THE A♠, K♠, AND J♠."

Figure 2C:
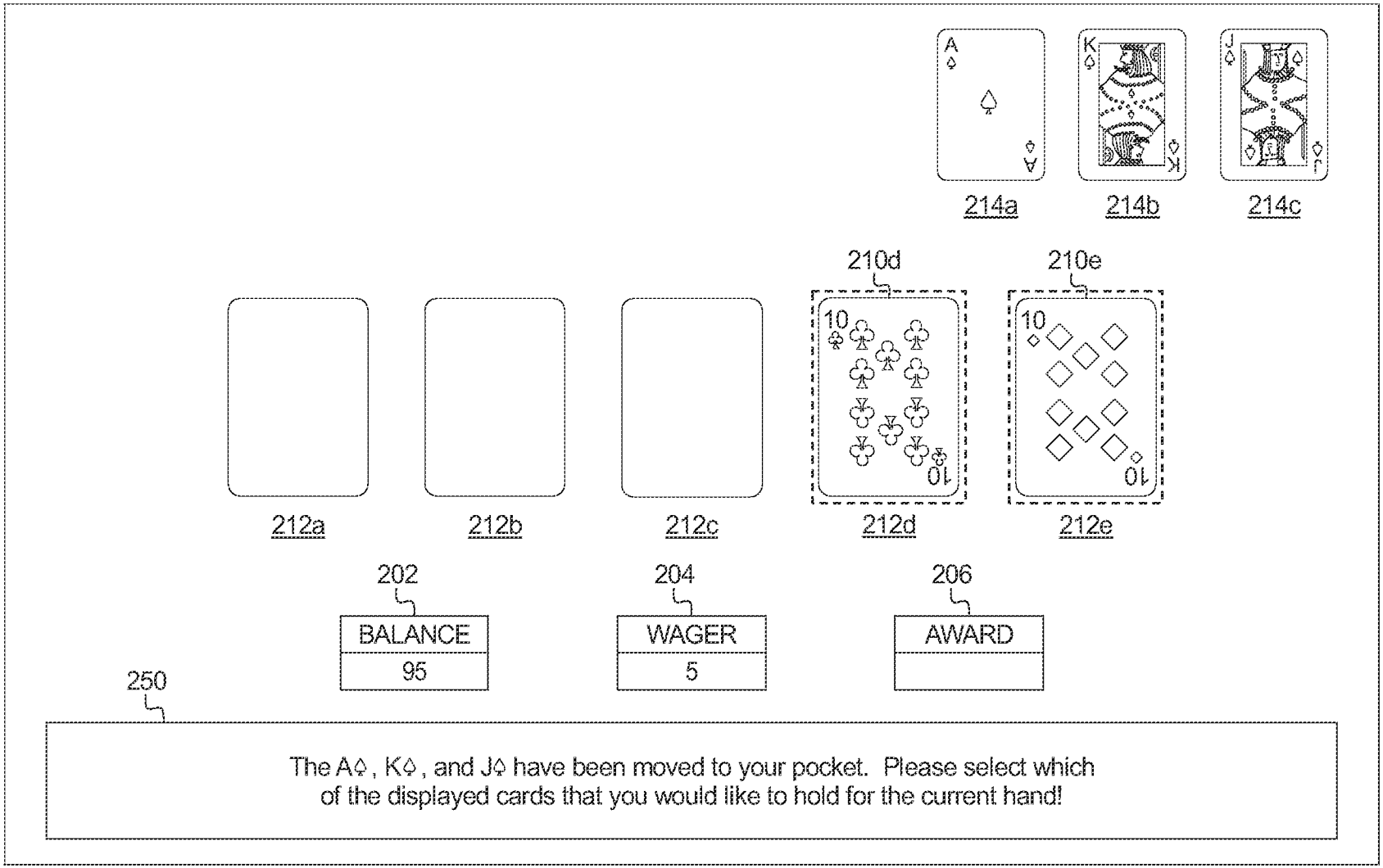

As illustrated in FIG. 2C, the gaming system removes the three cards selected to be saved for a subsequent play of the game from the displayed first hand of cards 210. In this example, the gaming system moves the saved cards to the saved card positions 212*a*, 212*b*, and 212*c*. The first hand of cards includes two remaining unselected cards 10♣ and 10♦ as indicated by 210*d* and 210*e*. The gaming system enables the player to select zero, one, or a plurality of the remaining cards 210*d* and 210*e* cards to hold for the current play of the game. The gaming system displays the following message in the message box 250: "THE A♠, K♠, AND J♠ HAVE BEEN MOVED TO YOUR POCKET. PLEASE SELECT WHICH OF THE DISPLAYED CARDS THAT YOU WOULD LIKE TO HOLD FOR THE CURRENT HAND!"

Figure 2D:
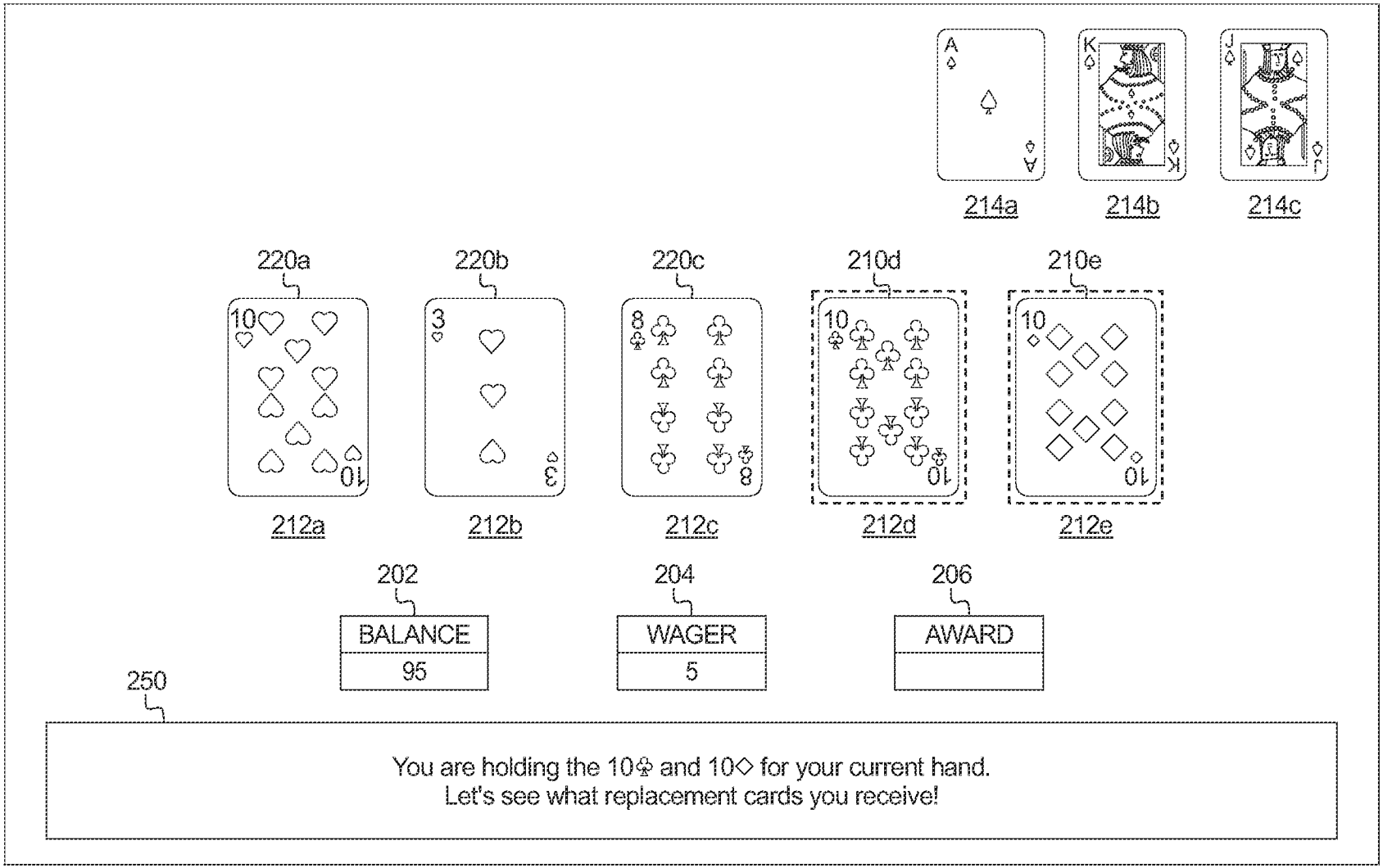

As illustrated in FIG. 2D, the player selects to hold both the 10♣ and 10♦, as indicated by 210*d* and 210*e*. In this example, there are no remaining unselected cards to discard. In this embodiment, the gaming system provides three replacement cards to complete the displayed first hand of cards for a final first hand of cards. The gaming system displays the following message in the message box 250: "YOU ARE HOLDING THE 10♣ and 10♦ FOR YOUR CURRENT HAND. LET'S SEE WHAT REPLACEMENT CARDS YOU RECEIVE!"

Figure 2E:
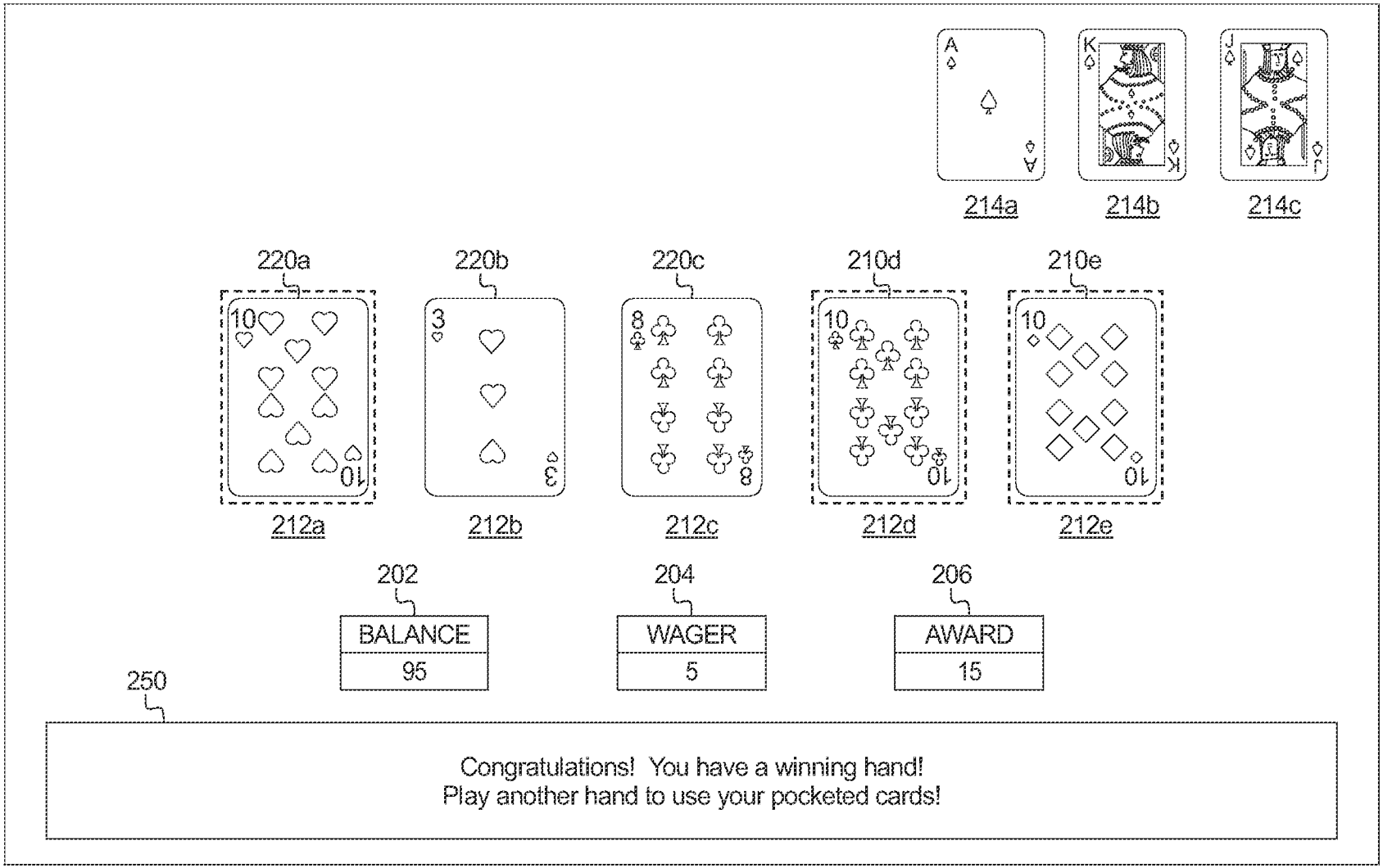

As illustrated in FIG. 2E, the gaming system provides and displays replacement cards 10♥, 3♥, and 8♣ as indicated by

220*a*, 220*b*, and 220*c*, to complete the displayed hand of cards for a final first hand of cards. In this embodiment, the gaming system randomly selects the replacement cards from the first virtual deck cards. The gaming system determines the game outcome for the play of the game and provides any award associated with any determined game outcome. In this embodiment, based on a standard five-card Jacks or Better paytable, shown below, the displayed final first hand of cards includes a winning card combination, (e.g., 10♥, 10♣ and 10♦). The gaming system provides and displays the award (e.g., 15 credits) associated with the determined game outcome based on the initial wager of 5 credits. The gaming system displays the following message in the message box 250: "CONGRATULATIONS! YOU HAVE A WINNING HAND! PLAY ANOTHER HAND TO USE YOUR POCKETED CARDS!"

TABLE 2

Example Jacks or Better Paytable

| | 1 Credit | 2 Credits | 3 Credits | 4 Credits | 5 Credits |
|---|---|---|---|---|---|
| Royal Flush | 250 | 500 | 750 | 1000 | 4000 |
| Straight Flush | 50 | 100 | 150 | 200 | 250 |
| Four of a Kind | 25 | 50 | 75 | 100 | 125 |
| Full House | 9 | 18 | 27 | 36 | 45 |
| Flush | 6 | 12 | 18 | 24 | 30 |
| Straight | 4 | 8 | 12 | 16 | 20 |
| Three of a Kind | 3 | 6 | 9 | 12 | 15 |
| Two Pair | 2 | 4 | 6 | 8 | 10 |
| Jacks or Better | 1 | 2 | 3 | 4 | 5 |

Turning now to FIGS. 3A to 3E, which illustrate a second play of the game of the example embodiment of the present disclosure described with respect with FIGS. 2A to 2E.

Figure 3A:
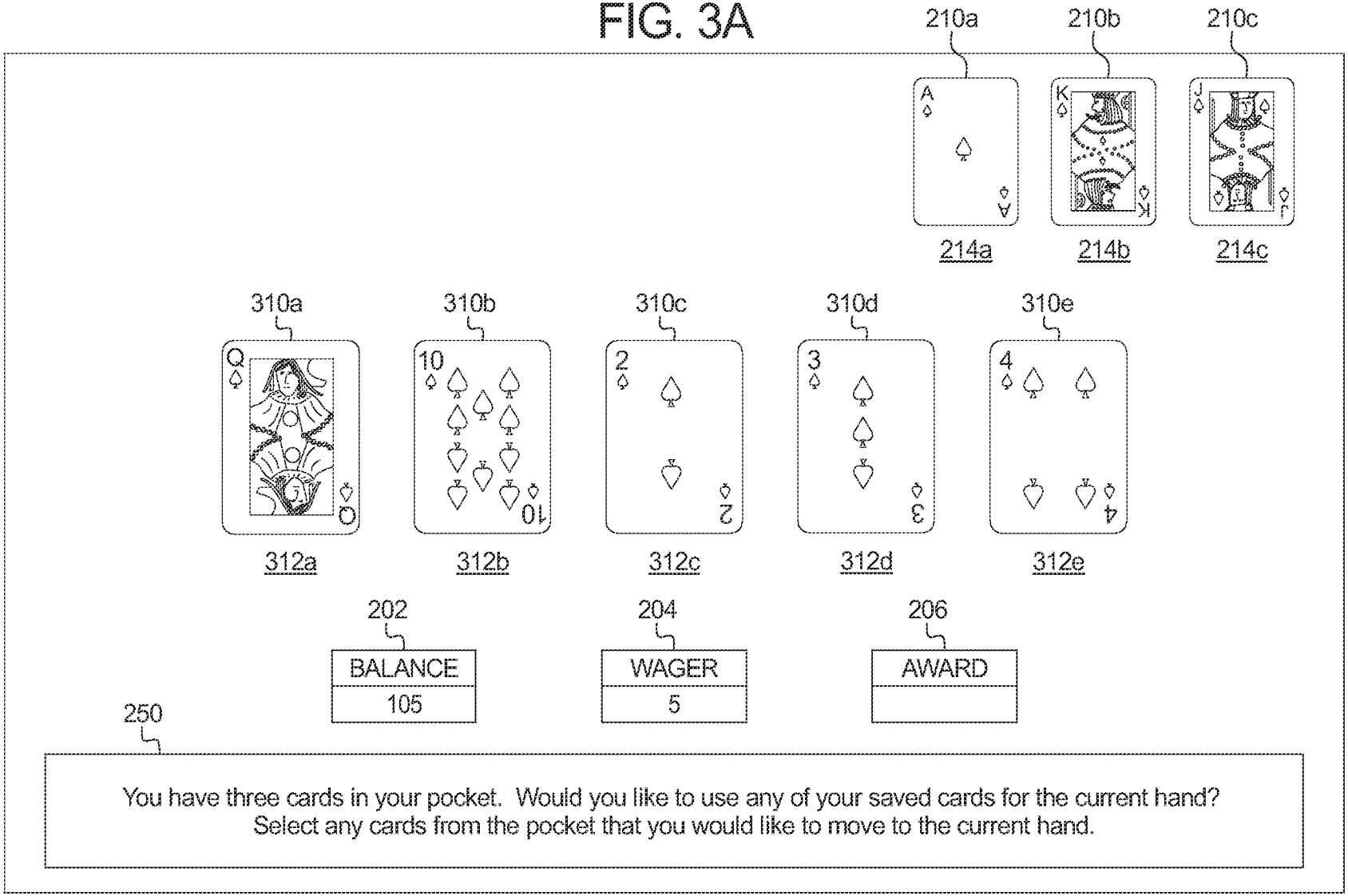
FIGS. 3A, 3B, 3C, 3D, and 3E illustrate screen shots of an example of one embodiment of the gaming system of the present disclosure providing a plurality of plays of a game, wherein the gaming system enables the player to hold one or more cards for a subsequent play of the game according to the method of FIG. 1.

As illustrated in FIG. 3A, in this embodiment, the gaming system displays the three cards saved from the previous play of the game, the A♠, K♠, and J♠, at positions 214*a*, 214*b*, and 214*c*. For the second play of the game, the gaming system randomly selects a second hand of cards 310 including five cards 310*a*, 310*b*, 310*c*, 310*d*, and 310*e* from the first virtual deck of 49 cards (e.g., the first virtual deck of 52 cards without the three saved cards from the previous play of the game). The gaming system displays the second hand of cards 310 face up at positions 312*a*, 312*b*, 312*c*, 312*d*, and 212*e*. More specifically, in this example embodiment, the gaming system displays the second hand of cards including the: Q♠, 10♠, 2♠, 3♠, and 4♠ as indicated by 310*a*, 310*b*, 310*c*, 310*d* and 310*e*.

For the second play of the game, because the player has three saved cards from a previous play of the game, the gaming system enables the player select one or more of the saved cards to use in the current hand for the current play of game. It should be appreciated that the player already has a winning card combination based on a standard Jacks or Better five-card paytable. The displayed hand includes a winning card combination of a flush. It should also be appreciated that the saved cards are of the same suit and by enabling the player to use the saved cards, the gaming system enables the player to obtain a winning card combination associated with a greater award (e.g., a straight flush). The gaming system displays the following message in the message box 250: "YOU HAVE THREE CARDS IN YOUR POCKET. WOULD YOU LIKE TO USE ANY OF YOUR SAVED CARDS FOR THE CURRENT HAND? SELECT ANY CARDS FROM THE POCKET THAT YOU WOULD LIKE TO MOVE TO THE CURRENT HAND."

Figure 3B:
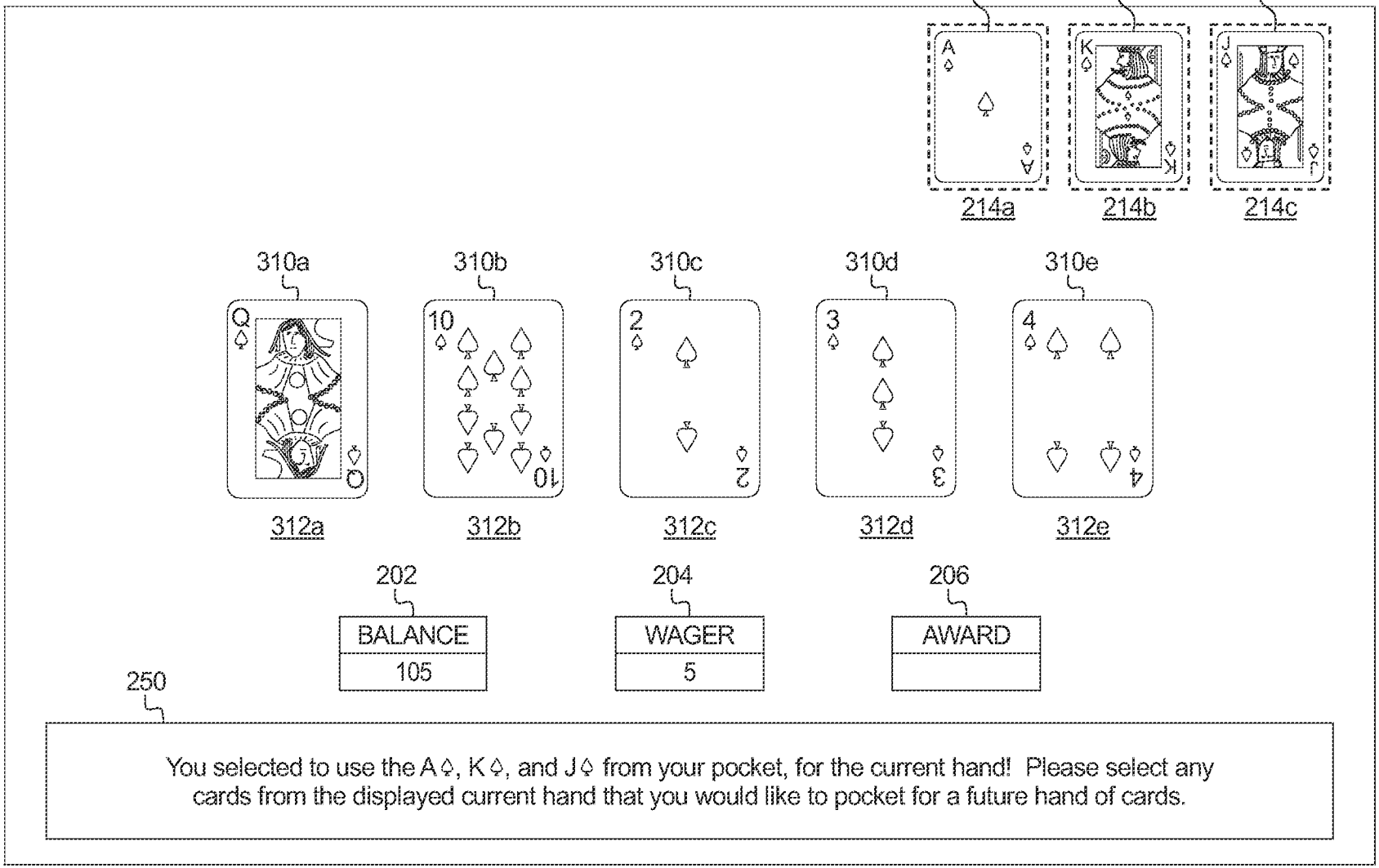

As illustrated in FIG. 3B, the player selects all three of the saved cards A♣, K♣, and J♣ from the previous play of the game to use for the current play of the game. The gaming system also enables the player to select a second quantity of up to the designated quantity of cards from the second hand to save for a subsequent play of the game. The gaming system displays the following message in the message box 250: "YOU SELECTED TO USE THE A♣, K♣, and J♣ FROM YOUR POCKET, FOR THE CURRENT HAND! PLEASE SELECT ANY CARDS FROM THE DISPLAYED CURRENT HAND THAT YOU WOULD LIKE TO POCKET FOR A FUTURE HAND OF CARDS.

Figure 3C:
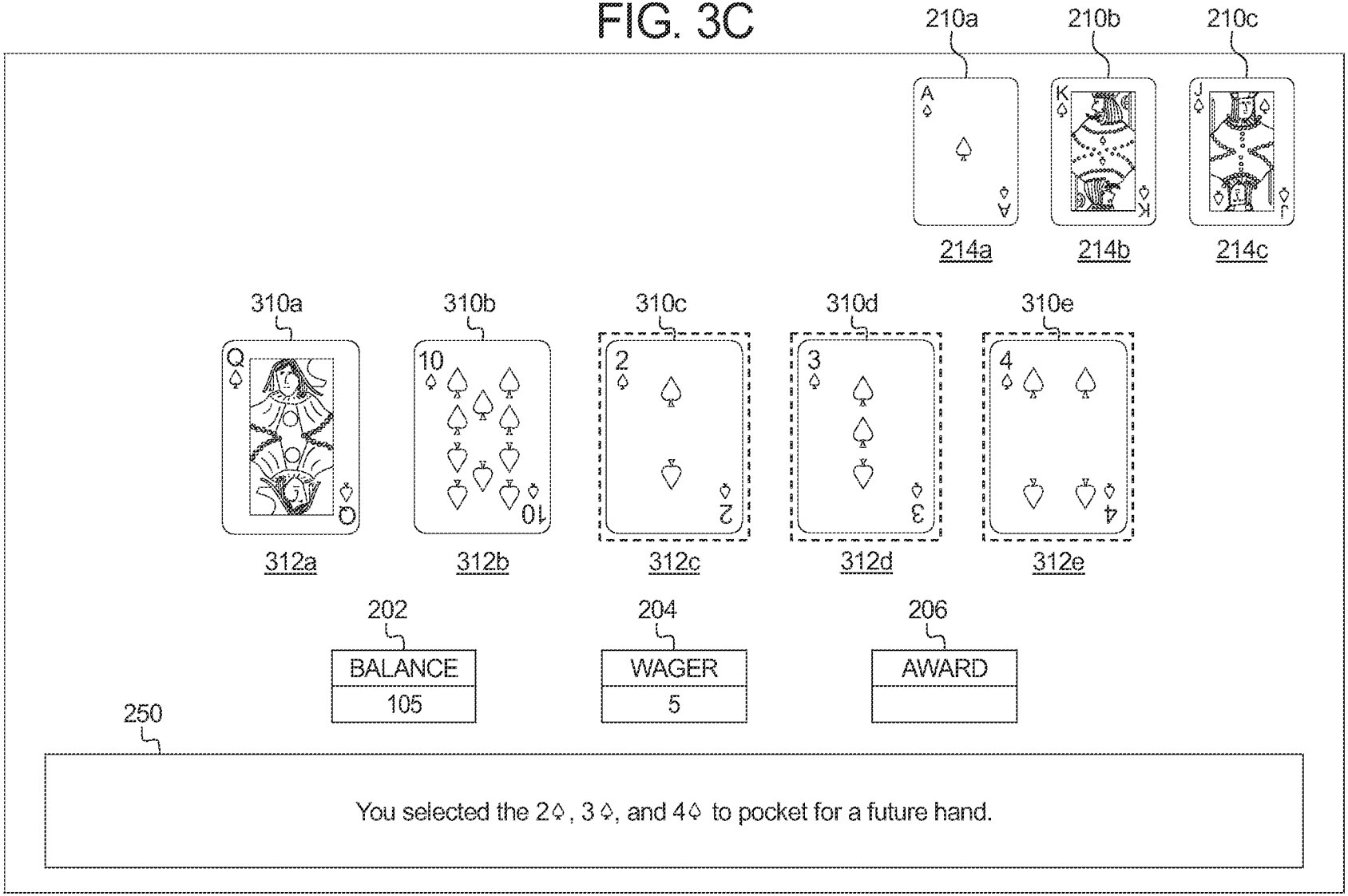

As illustrated in FIG. 3C, in this example, the player selects to save a second quantity of three cards, the 2♣, 3♣, AND 4♣ as indicated by 310*c*, 310*d*, and 310*e*, for a subsequent play of the game. The gaming system determines whether the second quantity of cards is greater than the quantity of available saved card positions. The quantity of available saved card positions is the designated quantity of cards minus any remaining unused cards. In this example, the designated quantity of saved card positions is three cards. The player selected to use all three cards currently in the saved card positions 214*a*, 214*b*, and 214*c*. Thus, all three saved card positions are available and the second quantity of three cards is equal to (e.g., not greater than) the quantity of available saved card positions. Since the second quantity of cards is less than or equal to the quantity of open positions, the gaming system adds the second quantity of selected cards to the available saved card positions. In this example, the gaming system adds the 2♣, 3♣, and 4♣ to the available saved positions 214*a*, 214*b*, and 214*c*. The gaming system displays the following message in the message box 250: "YOU SELECTED THE 2♣, 3♣, AND 4♣ TO POCKET FOR A FUTURE HAND."

It should be appreciated that if the second quantity of cards is greater than the quantity of available saved card positions, the gaming system enables the player to select one or more saved cards to remove and replace with one or more of the second quantity of selected cards.

Figure 3D:
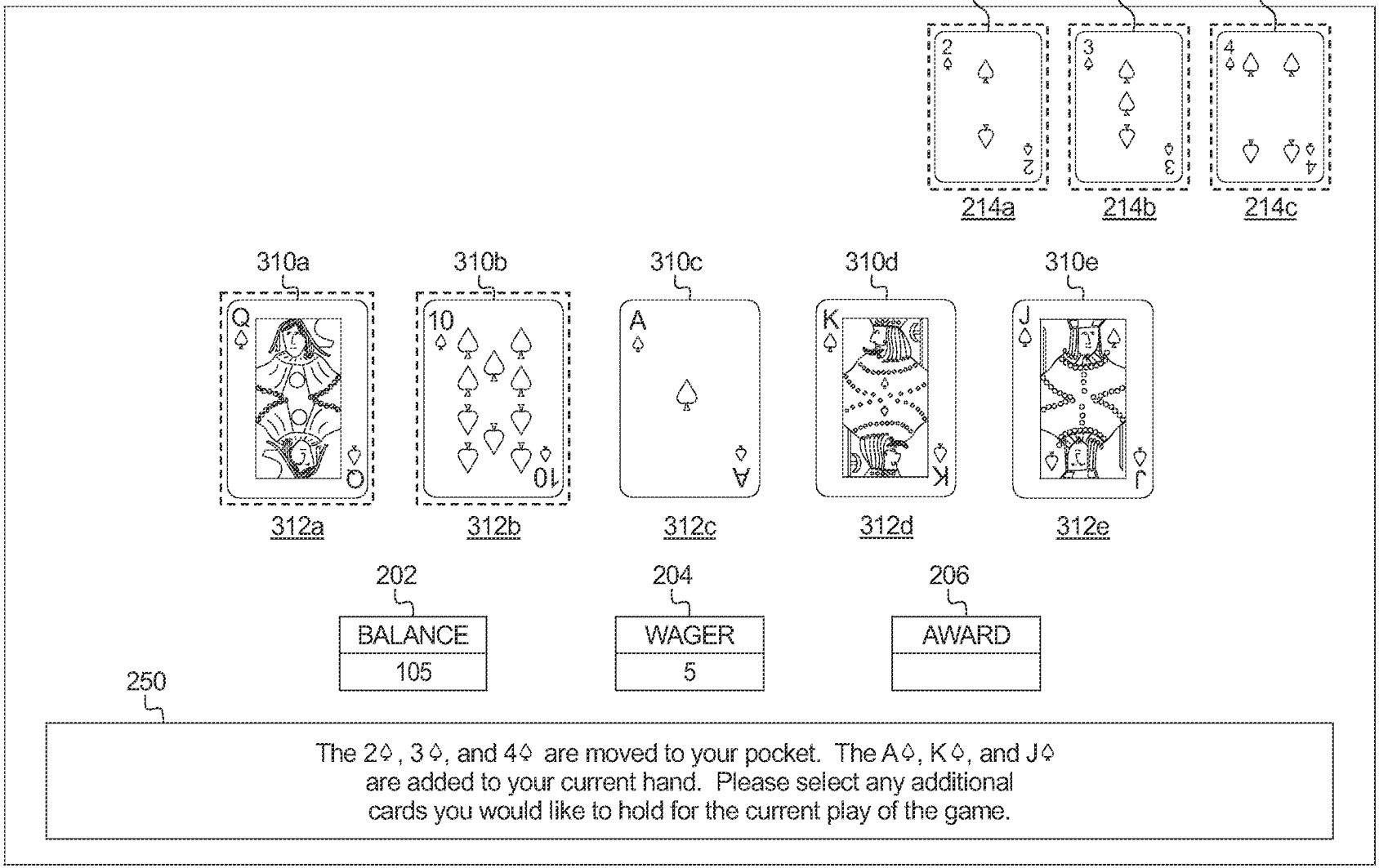

As illustrated by FIG. 3D, the gaming system moves the A♠, K♠, and J♠ from the saved cards positions 214*a*, 214*b*, and 214*c* to the current hand to positions 312*c*, 312*d*, and 312*e*. The gaming system moves the 2♠, 3♠, and 4♠ to the saved card positions 214*a*, 214*b*, and 214*c*. In this embodiment, after the gaming system displays the cards from the previous play of the game, the gaming system enables the player to select zero, one or a plurality of the remaining unselected cards, 310*a* and 310*b*, to hold for the current play of the game. The gaming system displays the following message in the message box 250: "THE 2♠, 3♠, AND 4♠ ARE MOVED TO YOUR POCKET. THE A♠, K♠, AND J♠ ARE ADDED TO YOUR CURRENT HAND. PLEASE SELECT ANY ADDITIONAL CARDS YOU WOULD LIKE TO HOLD FOR THE CURRENT PLAY OF THE GAME."

Figure 3E:
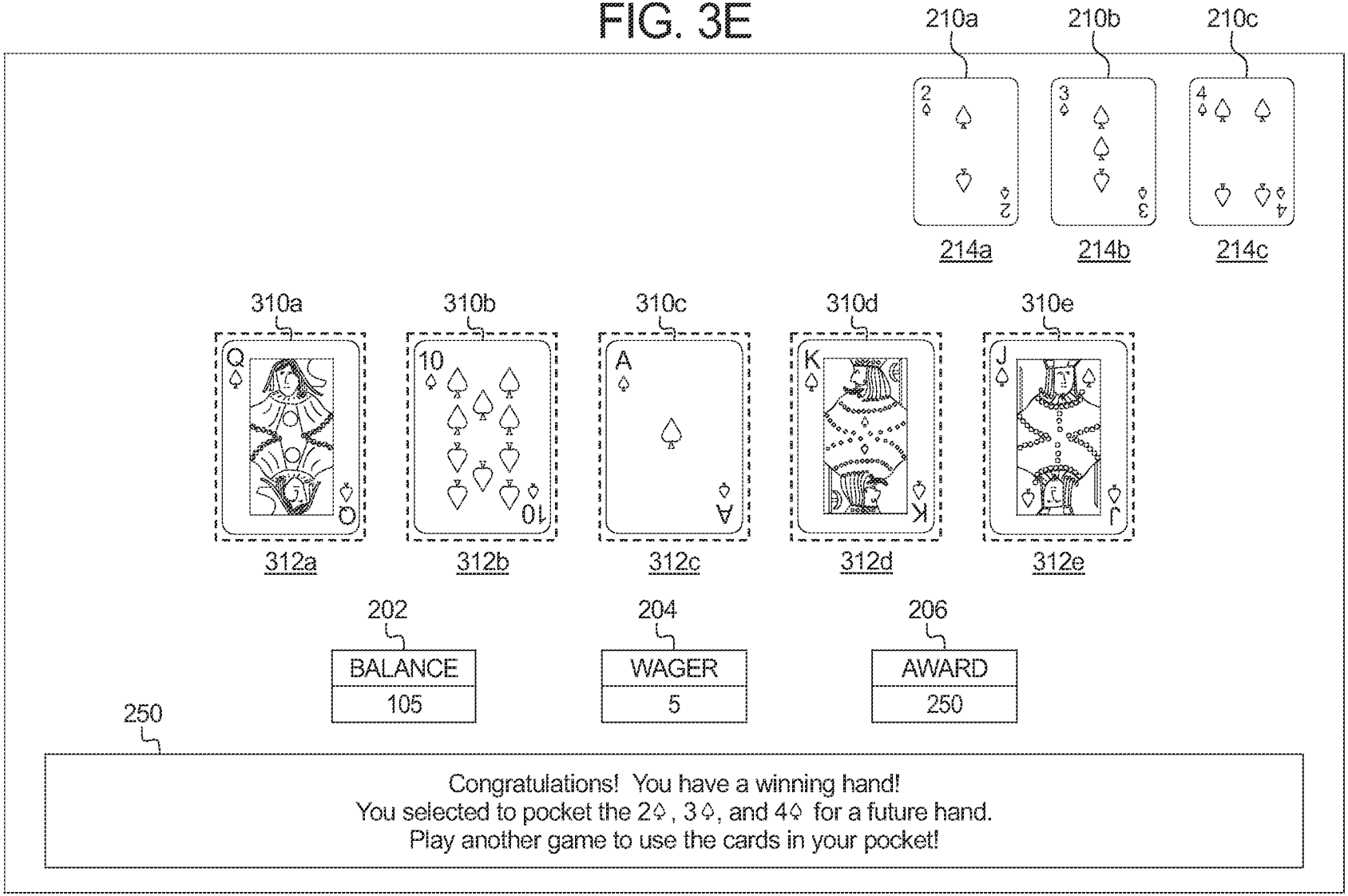

As illustrated by FIG. 3E, the player selects to hold the Q♠ and 10♠ in addition to the saved cards from the previous play of the game A♠, K♠, and J♠. Because there are no unselected cards remaining, the gaming system does not discard any cards. The displayed cards form a complete final second hand, thus, the gaming system does not provide any replacement cards. The gaming system determines the game outcome based on the second final hand of cards. The second final hand of cards includes Q♠, 10♠, A♠, K♠, AND J♠, which is a winning card combination based on the standard Jacks or Better five-card paytable. The gaming system provides the award of 250 credits associated with the determined game outcome. The gaming system displays the following message in the message box 250: "CONGRATULATIONS! YOU HAVE A WINNING HAND! YOU SELECTED TO POCKET THE 2♠, 3♠, AND 4♠ FOR A FUTURE HAND. PLAY ANOTHER GAME TO USE THE CARDS IN YOUR POCKET!"

Turning now to FIGS. 4A to 4E, which illustrate a third play of the game of the example embodiment of the present disclosure described with respect with FIGS. 2A to 2E and 3A to 3E.

Figure 4A:
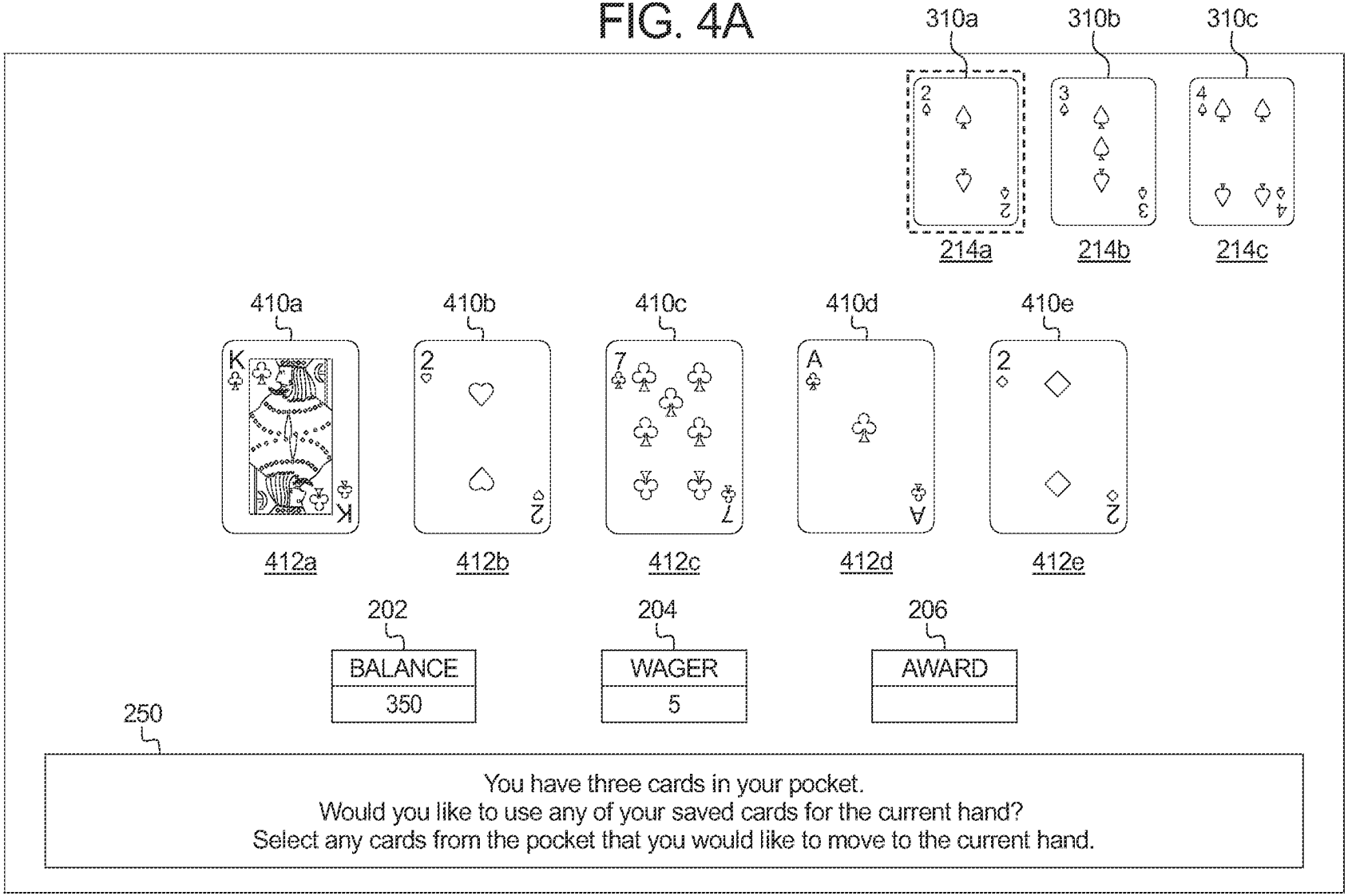
FIGS. 4A, 4B, 4C, 4D, and 4E illustrate screen shots of an example of one embodiment of the gaming system of the present disclosure providing a plurality of plays of a game, wherein the gaming system enables the player to hold one or more cards for a subsequent play of the game according to the method of FIG. 1.

Turning to FIG. 4A, in this embodiment, for the third play of the game, the gaming system displays the cards saved from the previous play of the game 2♠, 3♠, and 4♠ at the saved card positions 214*a*, 214*b*, and 214*c*. For the third play of the game, the gaming system randomly selects a third hand of cards 410 including five cards 410*a*, 410*b*, 410*c*, 410*d*, and 410*e* from the first virtual deck of 49 cards (e.g., the first virtual deck of 52 cards without the three saved cards from the previous play of the game). After randomly selecting the third hand of cards, the gaming system displays the third hand of cards 410 face up at positions 412*a*, 412*b*, 412*c*, 412*d*, and 412*e*. More specifically, in this example embodiment, the gaming system displays the third hand of cards including the: K♣, 2♥, 7♣, A♣, and 2♦ as indicated by 410*a*, 410*b*, 410*c*, 410*d* and 410*e*.

For the third play of the game, because the player has cards saved from a previous play of the game, the gaming system enables the player select one or more of the saved cards to play in the current hand for the current play of game. The gaming system displays the following message in the message box 250: "YOU HAVE THREE CARDS IN YOUR POCKET. WOULD YOU LIKE TO USE ANY OF YOUR SAVED CARDS FOR THE CURRENT HAND? SELECT ANY CARDS FROM THE POCKET THAT YOU WOULD LIKE TO MOVE TO THE CURRENT HAND." In this example, the player selects the 2♠ as indicated by 310*a* at saved card position 214*a* from the previous play of the game.

Figure 4B:
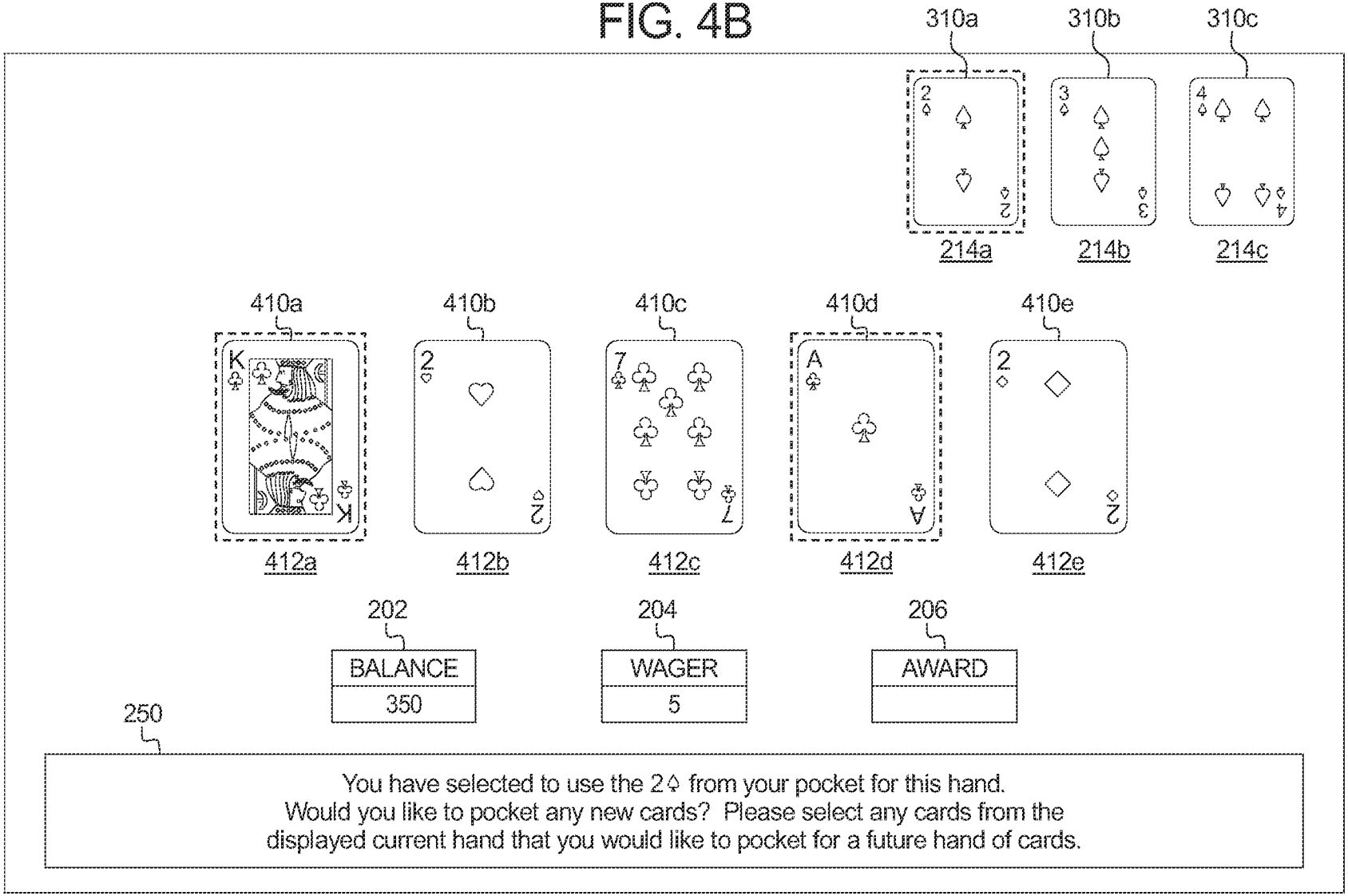

Turning to FIG. 4B, the gaming system also enables the player to select a third quantity, up to the designated quantity, of cards from the third hand to save for a subsequent play of the game. The gaming system displays the following message in the message box 250: "YOU HAVE SELECTED TO USE THE 2♠ FROM YOUR POCKET FOR THIS HAND. WOULD YOU LIKE TO POCKET ANY NEW CARDS? PLEASE SELECT ANY CARDS FROM THE DISPLAYED CURRENT HAND THAT YOU WOULD LIKE TO POCKET FOR A FUTURE HAND OF CARDS."

In this example, the player selects a third quantity of two cards the, K♣ and A♣ as indicated by 410*a* and 410*d*, to save for a subsequent play of the game. The gaming system determines that the third quantity of two cards is greater than the quantity of available saved card positions, wherein the quantity of available saved card positions is the designated quantity of cards minus any remaining unused cards. In this example, the player is using one of the three previously saved cards in the current play of the game, thus, there is one unused saved card position. The player selects two card from the current hand to save for a subsequent play of the game. Thus, the third quantity is greater than the available saved card positions.

Figure 4C:
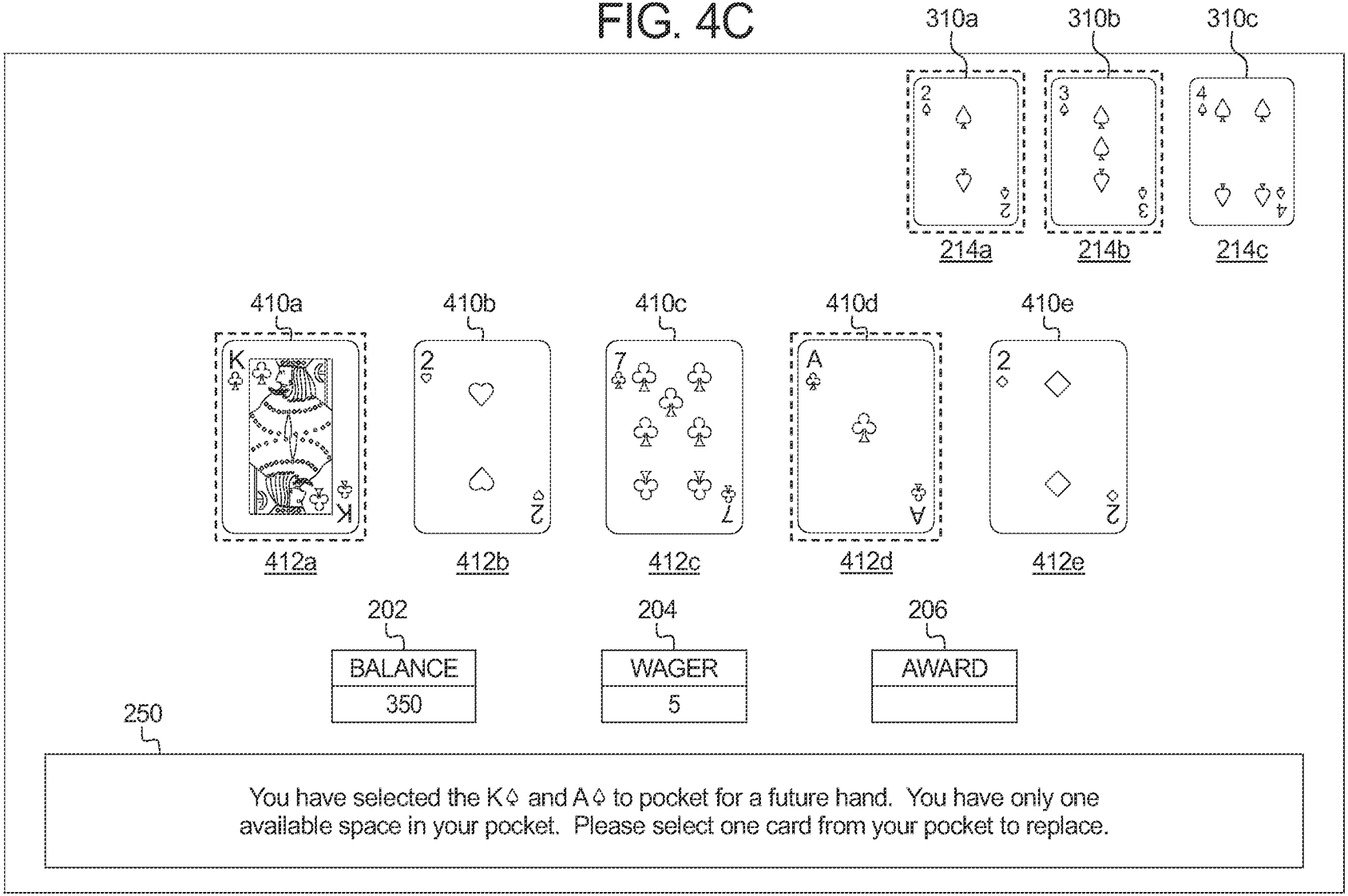

As illustrated in FIG. 4C, since the third quantity of cards is greater than the quantity of available saved card positions the gaming system enables the player to select one or more saved cards to remove and replace with one or more of the second quantity of selected cards. It should be appreciated that since the player is using one of the saved cards, the player only needs to select one of the two remaining saved cards to replace. The gaming system displays the following message in the message box 250: "YOU SELECTED THE K♣ and A♣ TO POCKET FOR A FUTURE HAND. YOU ONLY HAVE ONE AVAILABLE SPACE IN YOUR POCKET. PLEASE SELECT ONE CARD FROM YOUR POCKET TO REPLACE."

Figure 4D:
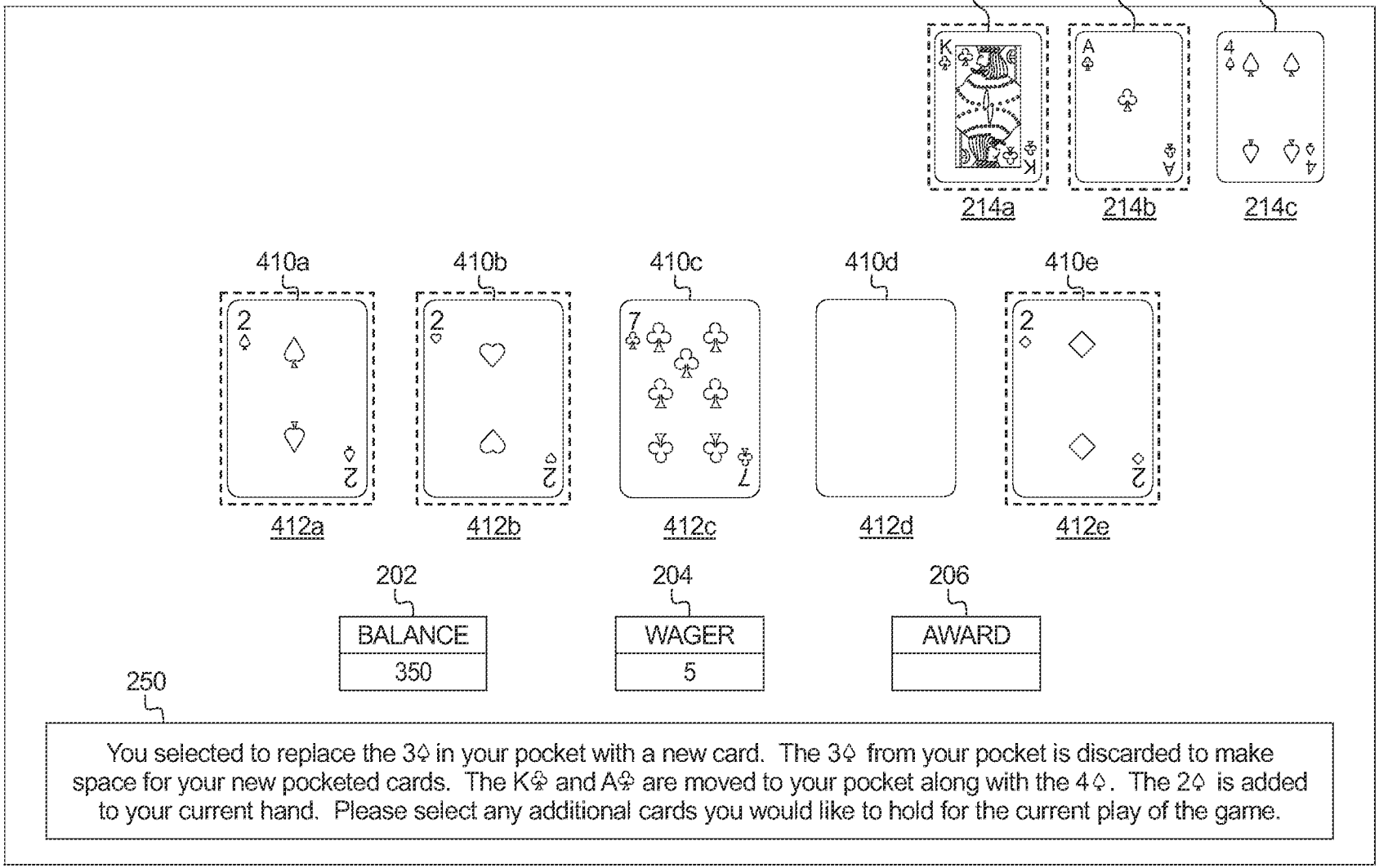

In this embodiment, the gaming system enables the player to select one or more of the saved cards to replace with a new card from the current hand. In this example, the player selects to replace the 3♠. As illustrated in FIG. 4D, the gaming system moves the 2♠ from the saved card position 214*a* to the displayed card position 412*a* and the gaming system moves the K♣ and A♣ from the displayed card positions 412*a* and 412*d* to the saved card positions 214*a* and 214*b*. In this embodiment, after the gaming system displays the cards from the previous play of the game, the gaming system enables the player to select zero, one or a plurality of the remaining cards from the displayed third hand to hold for the current play of the game. The gaming system displays the following message in the message box 250: "YOU SELECTED TO REPLACE THE 3♠ IN YOUR POCKET WITH A NEW CARD. THE 3♠ FROM YOUR POCKET IS DISCARDED TO MAKE SPACE FOR YOUR NEW POCKETED CARDS. THE E K♣ and A♣ ARE MOVED TO YOUR POCKET ALONG WITH THE 4♠. THE 2♠ IS ADDED TO YOUR CURRENT HAND. PLEASE SELECT ANY ADDITIONAL CARDS YOU WOULD LIKE TO HOLD FOR THE CURRENT PLAY OF THE GAME."

Figure 4E:
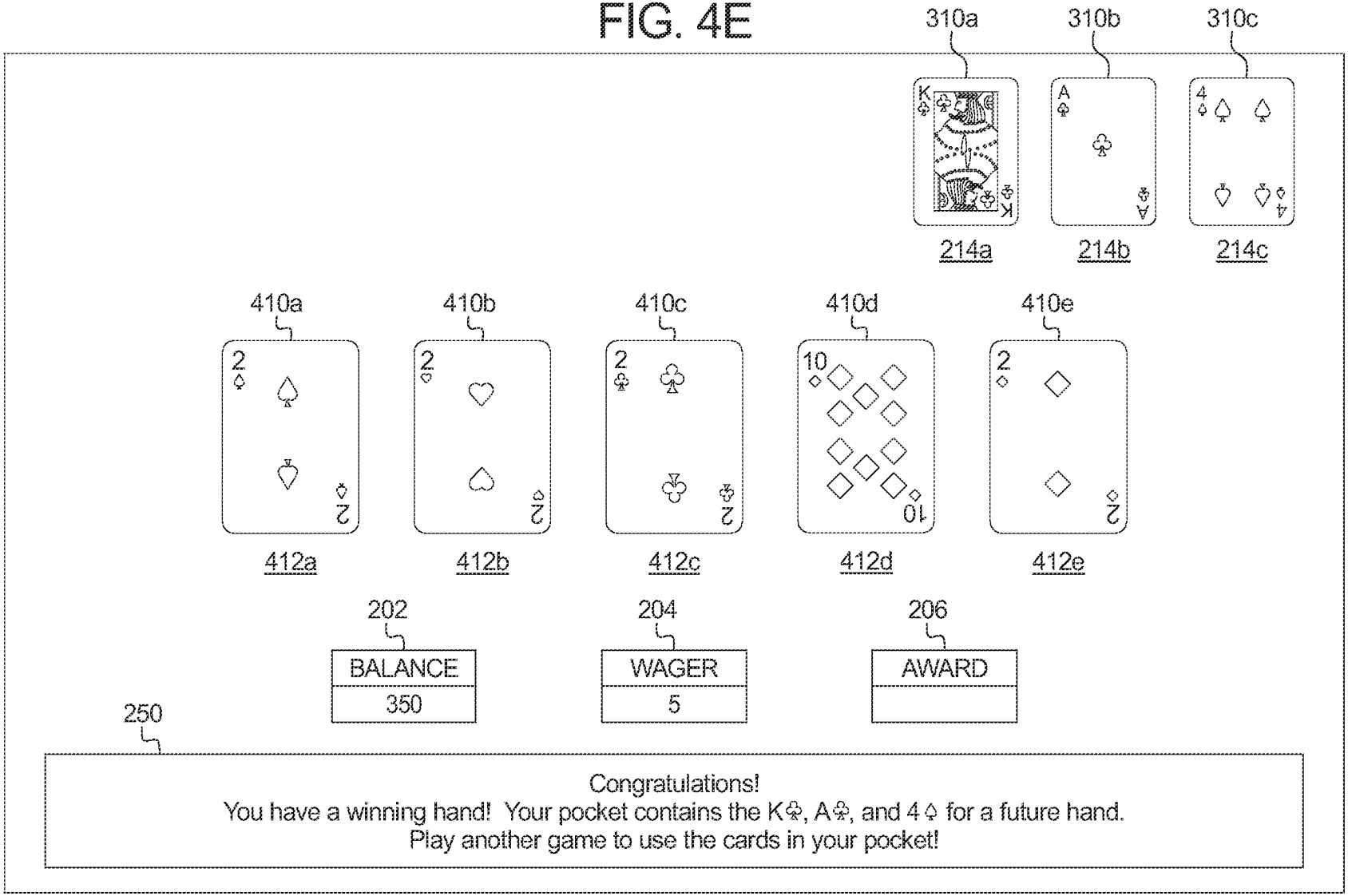

As illustrated by FIG. 4E, the player selects to hold the 2♥, and 2♦. In addition to the saved cards from the previous play of the game 2♠. There is one unselected card remaining, 7♣. The gaming system discards 7♣ and provides two replacement cards to complete the final third hand of cards (e.g., for the discarded 7♣ and for the saved cards). It should be appreciated that in this embodiment, the gaming system provides a replacement card for cards that are saved and cards that are discarded. In certain alternative embodiment, the gaming system does not provide replacement cards for any cards saved for a subsequent play of the game. Thus, in an example of such an embodiment, the final hand of cards may include a reduced quantity of cards less than the initial five-card hand.

The gaming system determines the game outcome based on the third final hand of cards. The third final hand of cards includes 2♠, 2♥, 2♣, 10♦, and 2♦, which is a winning card combination based on the standard Jacks or Better five-card paytable. The gaming system provides the award associated with the determined game outcome. The gaming system displays the following message in the message box 250: "CONGRATULATIONS! YOU HAVE A WINNING HAND! YOUR POCKET CONTAINS THE K♣, A♣, AND 4♠ FOR A FUTURE HAND. PLAY ANOTHER GAME TO USE THE CARDS IN YOUR POCKET!"

It should be appreciated by the example embodiments described above, that the gaming system enables the player to convert a losing card combination into a winning card combination, or a winning combination into an even better winning combination associated with a greater award. In this embodiment, the gaming system enables the player to improve current and future hands of cards by enabling the player to save cards for a subsequent play of a game, and used previously saved cards.

It should be appreciated that in this example embodiment, the gaming system determines the game outcome based on a five-card hand. In certain alternative embodiments, as will be discussed in greater detail below, the gaming system does not provide replacement cards for any saved cards and thus the final hand of cards includes a reduced quantity of cards from the initial hand of cards. In an example of such an embodiment, the gaming system determines the game outcome based on a different modified paytable for a reduced number of cards.

Wager for Saving Cards

In the example described above with respect to FIGS. 2A to 2E, 3A to 3E, and 4A to 4E, the main wager for the primary card game funds the base game and the saving cards feature. In various alternative embodiments, the gaming system receives a separate wager for the primary or base game and a separate secondary or side wager for the saving cards feature. In one embodiment, the saving cards feature may additionally or alternatively be employed as or in association with a bonus game or a secondary game upon receiving a side bet in addition to the primary wager for the base game. In one such embodiment, a player must place or wager a side bet to be eligible to receive the saving cards feature associated with the side bet. In an alternative embodiment, the player must place a maximum wager for the primary game and a side wager to be eligible for the combining cards feature.

In the example embodiment described above, the gaming system enables the player to place a plurality of wagers and each wager funds each play of the game. In another alternative embodiment, a single wager funds a plurality of hands of cards and the gaming system enables the player to save cards from a first hand for a second hand. In another embodiment, the gaming system enables the player to saved cards from a displayed hand for a period of time.

Virtual Deck

It should be appreciated that in the example embodiments described above with respect to FIGS. 2A to 2E, 3A to 3E, and 4A to 4E, the gaming system uses the same virtual deck of 52 cards for each of the plurality of plays of the game. Thus, all cards saved from a play of the game are removed from the virtual deck of cards for a subsequent play of the game. For example, if in the first play of the game, the player saved three cards, in this example the gaming system selects the second hand of cards from the first virtual deck of 49 cards (i.e., 52 cards minus the three cards saved from the first hand of cards).

Various embodiments of the present disclosure employ a different virtual deck of 52 cards for each play of the game. In one example embodiment, the gaming system selects the second hand of cards from a second different virtual deck of 52 cards. For example, if in the first play of the game, the player saved three cards, in this example the gaming system selects the second hand of cards from a second different virtual deck of 52 cards. Thus, the gaming system is using the three saved cards from the first virtual deck of cards from the first play of the game and the 52 cards from the second virtual deck of cards. It should be appreciated that, if the gaming system selects the second hand of cards from a second different virtual deck of 52 cards, the possibility of other pay categories, such as five-of-a-kind winning card combinations, would exist.

Saving Cards

In various embodiments of the present disclosure, the gaming system enables the player to select a limited quantity of cards to save for a subsequent play of the game. In the example embodiment described above with respect to FIGS. 2A to 2E, 3A to 3E, and 4A to 4E, the gaming system enables the player to select a quantity of cards up to a designated quantity of three cards to save for each play of the game. It should be appreciated that the quantity of designated cards can vary such as one card, two cards, four cards, etc. In other alternative embodiments, there is no limit on the quantity of cards that the gaming system enables the player to select to pocket for each play of the game.

In various alternative embodiments of the present disclosure the gaming system provides a designated quantity of saved cards for a gaming session including a plurality of plays. More specifically, in one embodiment, instead of limiting the quantity of cards the player may select to save for each play of the game, the gaming system provides a designated quantity of total saved cards for multiple plays of the game. In one example, the designated quantity of saved cards is ten cards for the entire gaming session. In this example, the gaming system enables the player to select to save as many cards from each hand of cards for each play of the game until the player reaches the designated quantity of ten cards. It should be appreciated that as the player uses certain of the saved cards for subsequent plays of the game, the gaming system enables the player to open another space for another saved card. On the other hand, if the player reaches the designated quantity of ten cards, the player will have to replace one of the saved cards with any new cards the player chooses to save. In certain embodiments, the gaming system does not enable the player to replace saved cards. Thus, once a card is selected to be saved it must be used in order to make space for another card to save.

In various alternative embodiments, the gaming system enables the player to earn an extra saved card. For example, in one embodiment, the gaming system enables the player to earn an extra saved cards, wherein the gaming system enables the player to save more than a designated quantity of cards for a play of the game. In certain embodiments, the gaming system provides the extra saved card for a limited duration. In certain embodiments, the gaming system provides the extra saved card randomly. In other embodiments, the gaming system provides the extra saved card if a designated event occurs during the play of the game.

In the embodiment described above with respect to FIGS. 2A to 2E, 3A to 3E, and 4A to 4E, the gaming system enables a player to add and/or replace a quantity of saved cards from a previous play of the game with new cards from a current play of the game. More specifically, if the player has saved a first quantity of cards from a first play of the game, the gaming system enables the player to select additional cards from a second play of the game to add to and/or replace certain of the previously saved cards. In an alternative embodiment, the gaming system does not enable the player to add to or replace any saved cards with new cards until all of the previously saved cards have been used. In another embodiment, the gaming system enables the player to replace one or more of saved cards, but does not enable the player to add to the saved cards until all of the previously saved cards have been used. In another embodiment, the gaming system enables the player to add to the saved cards, but does not enable the player to replace any saved cards until all of the previously saved cards are used.

In various embodiments of the present disclosure, the gaming system automatically selects the cards to be saved for each play of the game. In the embodiments described above, the gaming system enables the player to select which cards, if any, to save for a subsequent play of the game. In one example of the alternative embodiment, for each play of the game, the gaming system selects which cards to save for a subsequent play of the game based on optimal strategy. In one example, the gaming system automatically saves the selected cards and removes the cards from the displayed hand. In another example, the gaming system automatically suggests to the player which cards should be saved based on optimal strategy and the gaming system enables the player to override the gaming system's suggestion. In another example, the gaming system suggests which cards to save based on optimal strategy if the player pays an additional wager for the feature.

Using Saved Cards

Various embodiments of the present disclosure include a duration within which any previously saved cards must be used. In the example embodiment described above, there is no duration within which the player must use any saved cards. Thus, the gaming system enables the player to choose not to use any saved cards for the subsequent play of the game.

In certain alternative embodiments, the gaming system only enables the player to use saved cards for a limited duration. For example, in one embodiment, the gaming system enables the player to use any saved cards in the play of the game immediately following the play of the game from which the saved cards were selected. In that example, if the player does not use the saved cards in the play of the game immediately following the play of the game from which the saved cards were selected, the gaming system removes the saved cards for all subsequent plays of the game. In another alternative embodiment, the saved cards are associated with an expiration duration. More specifically, in one such embodiment, each saved card is associated with an expiration duration, where in the duration includes a period of time or a quantity of plays of the game. In this example, the gaming system removes any unused saved cards once the duration is complete. In one example of this embodiment, all cards selected to be saved from the same play of the game are associated with the same expiration duration. In another example of this embodiment, all cards are associated with a plurality of different expiration durations.

In various alternative embodiments, the gaming system enables the player to earn an extra use of a saved card. For example, in one embodiment, the gaming system enables the player to earn an extra use of a saved cards, wherein the gaming system enables the player to use a saved card in more than one play of a game. In certain embodiments, the gaming system provides the opportunity for an extra use of a saved card for a limited duration. In certain embodiments, the gaming system provides the extra use of the saved card randomly. In other embodiments, the gaming system provides the extra use of the saved card if a designated event occurs during the play of the game.

In the embodiment described above with respect to FIGS. 3A to 3E and 4A to 4E, the gaming system enables the player to use one or more of the saved cards for the current play of the game. In certain alternative embodiments, the gaming system does not enable a player to use less than all of the saved cards from a play of a game. More specifically, in one example embodiment, all cards saved cards from a first play of the game are considered a set of saved cards. In a subsequent play of the game, the gaming system enables the player to use the entire set of saved card. Thus, if the player saved three cards from a first play of the game, the gaming system does not enable the player to use less than all three of the saved cards in a second play of the game.

In various embodiments of the present disclosure, the gaming system automatically selects the cards to use for each play of the game. In the embodiments described above, the gaming system enables the player to select which of the previously saved cards, if any, to use in the current play of the game. In one alternative embodiment, for each play of the game, the gaming system selects which of the previously saved cards to use in the current play of the game based on optimal strategy. In one example of the alternative embodiment, the gaming system automatically selects which of the previously saved cards to use in the current play of the game. In this example, the gaming system adds the previously saved cards to the displayed current hand of cards without requiring the player to remove any of the displayed cards from the current hand of cards. In another example, the gaming system enables the player to select which of the displayed cards from the current hand to replace or discard in placed of the previously saved card. In another embodiment, the gaming system adds the previously saved card to the currently displayed hand and automatically removes certain of the displayed cards based on optimal strategy. In another example, the gaming system automatically suggests to the player which cards should be used in the current hand based on optimal strategy and the gaming system enables the player to override the gaming system's suggestion. In another example, the gaming system suggests which cards to use in the current hand based on optimal strategy if the player pays an additional wager for the feature.

Replacement Cards

In various embodiments of the present disclosure, the gaming system provides replacement cards after a draw phase during the play of the game. In the example embodiments described above, the gaming system enables the player to select: (1) which cards to use from any previously saved cards, (2) which new cards to save, and (3) which of the remaining currently displayed cards to hold. The gaming system then discards any unselected cards and provides replacement cards for all cards that were removed (i.e., saved cards and discarded cards) to complete the displayed hand. In certain alternative embodiments, the gaming system does not provide replacement cards for any cards that are saved for a subsequent play of the game. More specifically, in one example, for a displayed hand of five cards a player selects: (1) to use one previously saved card in the current hand of cards (e.g., adding one card to the displayed hand), (2) save two new cards from the current hand of cards, thereby removing the two cards from the current hand of cards, and (3) hold two of the three remaining cards from the initial displayed hand of five cards. In this example, the final hand of cards includes one card from a previous play of the game, and two cards held from the current hand of cards because two cards from the initial hand of cards have been saved for a subsequent play of the game, and one card from the initial hand of cards, which remains unselected, is discarded. In this embodiment, the gaming system provides one replacement card for the one discarded card. The gaming system does not provide a replacement card for the two cards that are saved for a subsequent play of the game. The gaming system leaves a hand of four cards (one from a previous play of the game, two from the initial hand, and one replacement card).

In another alternative embodiment, the gaming system does not provide any replacement cards when a player selects any cards to save for a subsequent play of the game. More specifically, if the player selects any cards to save for a subsequent play of the game, the gaming system does not enable the player to select any cards to hold. The player's final hand is the hand of cards remaining after the player selects which cards to save. In another alternative embodiment, the gaming system does not provide any replacement cards when a player selects to use any cards from a previous play of the game. More specifically, if the player selects to use any cards from a previous play of the game, the gaming system does not enable the player to select any cards to hold. In this example, the gaming system determines a game outcome based on the initial hand of cards plus any previously saved cards used in the current hand.

It should be appreciated that in the embodiments described above, the gaming system enables the player to select previously saved cards to use in the current play of the game, and to select any cards from the initial hand in the current play of the game to save for a subsequent play of the game prior to the draw phase. In certain alternative embodiments, the gaming system enables the player to select previously saved cards to use in a current hand and/or select cards from the initial hand of the current play of the game after the draw phase. More specifically, in one embodiment, the gaming system: (1) randomly selects and displays a hand of cards; (2) enables the player to select zero, one, or a plurality of cards to hold; (3) discards the remaining cards; and (4) provides replacement cards to complete the hand of cards. In one example embodiment, after completing the hand of cards with replacement cards, the gaming system enables the player to select any previously saved cards to use in the current play of the game. If the player selects any previously saved cards to use in the current play of the game, the gaming system enables the player to select cards from displayed final hand of the current play of the game to either discard or swap with the previously saved cards. In another example, after completing the final hand of cards for the current play of the game, the gaming system enables the player to save a quantity of cards for a subsequent play of the game. In another embodiment, after completing the final hand of cards, the gaming system enables the player to both: (1) select previously saved cards to use in the current play of the game, and (2) select cards from the currently displayed final hand of cards to save for a subsequent play of the game.

Awards Associated with Winning Hands with Saved Cards

In various embodiments of the present disclosure the gaming system provides a modified paytable to evaluate hands of cards including any saved cards from a previous hand. In the example embodiments described above with reference to FIGS. 3A to 3E and 4A to 4E, the gaming system determined whether the final hand of cards included any winning card combinations based on a standard Jacks or Better five-card paytable. In certain alternative embodiments, because the final hand of cards in FIGS. 3A to 3E and 4A to 4E contain saved cards from a previous play of the game, the gaming system determines the game outcome based on a modified paytable.

It should be appreciated that in certain embodiments, the gaming system does not provide replacement cards for any cards removed from a displayed hand to be saved for a subsequent hand. In one example of this embodiment, the gaming system evaluates the final hand of a reduced quantity of cards. Thus, certain winning card combinations of the Jacks or Better paytable are not possible for a hand of cards including a reduced quantity of cards such as a four-card hand. In this example, the gaming system determines the game outcome by evaluating the hand of cards including a reduced quantity of cards based on a modified four-card paytable. In certain alternative embodiments, the gaming system provides a modified award for winning card combinations including any saved cards from a previous hand.

It should be appreciated that the awards may be any suitable awards such as, but not limited to: (1) monetary credits or currency; (2) non-monetary credits or currency; (3) a modifier (such as a multiplier) used to modify one or more awards; (4) one or more free plays of a game (such as one or more free spins of a slot game); (5) one or more plays of one or more bonus games (such as a free spin of an award wheel); (6) one or more lottery based awards (such as one or more lottery or drawing tickets); (7) a wager match for one or more plays of the a wagering game; (8) an increase in an average expected payback percentage of a bonus game and/or an average expected payback percentage of a primary wagering game for one or more plays; (9) one or more comps (such as a free dinner or a free night's stay at a hotel); (10) one or more bonus or promotional credits usable for online play; (11) one or more player tracking points; (12) a multiplier for player tracking points or credits; (13) an increase in a membership or player tracking level; (14) one or more coupons or promotions usable within a gaming establishment and/or outside of the gaming establishment (e.g., a 20% off coupon for use at a retail store or a promotional code providing a deposit match for use in association with an online casino); (15) an access code usable to unlock content on the Internet; (16) a progressive jackpot or other progressive award; (17) a high value product or service (such as a car); and/or (18) a low value product or service (such as a teddy bear).

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more EGMs; and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to herein as an "EGM." Additionally, for brevity and clarity, unless specifically stated otherwise, "EGM" as used herein represents one EGM or a plurality of EGMs, and "central server, central controller, or remote host" as used herein represents one central server, central controller, or remote host or a plurality of central servers, central controllers, or remote hosts.

Figure 5A:
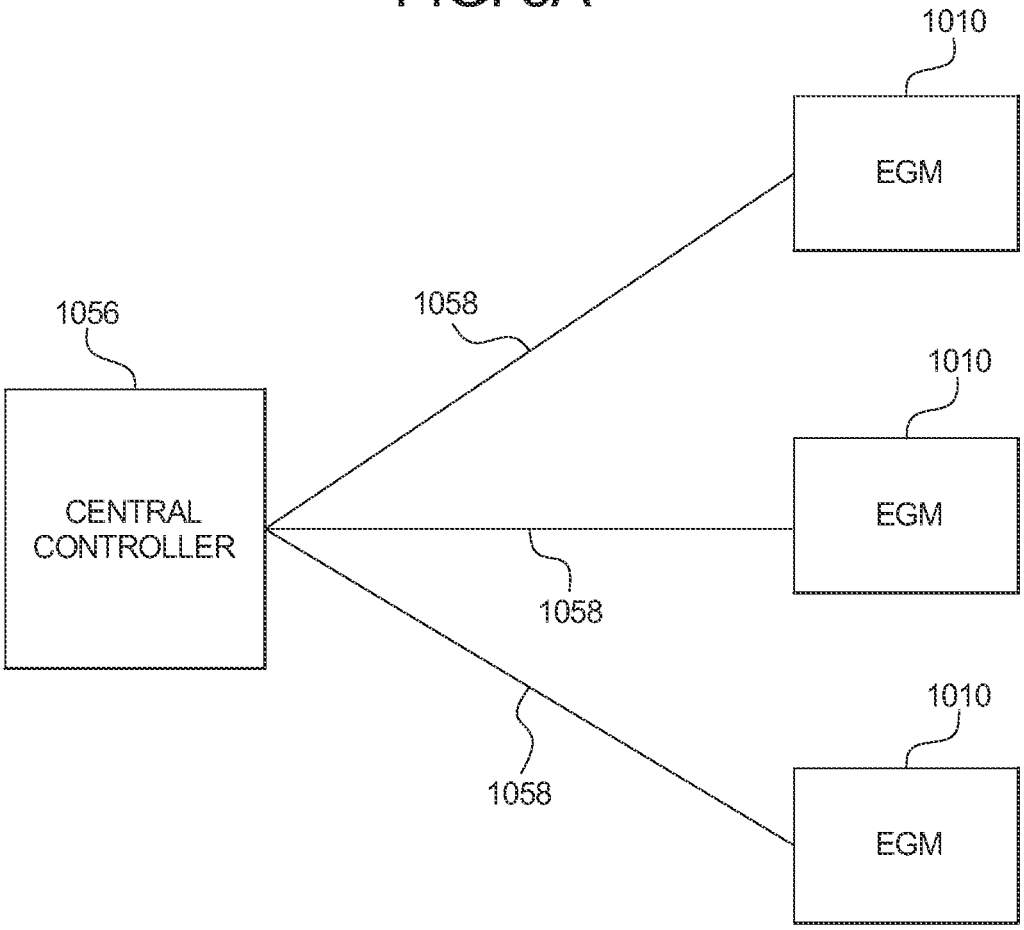
FIG. 5A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 3010 that are each configured to communicate with a central server, central controller, or remote host 3056 through a data network 3058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
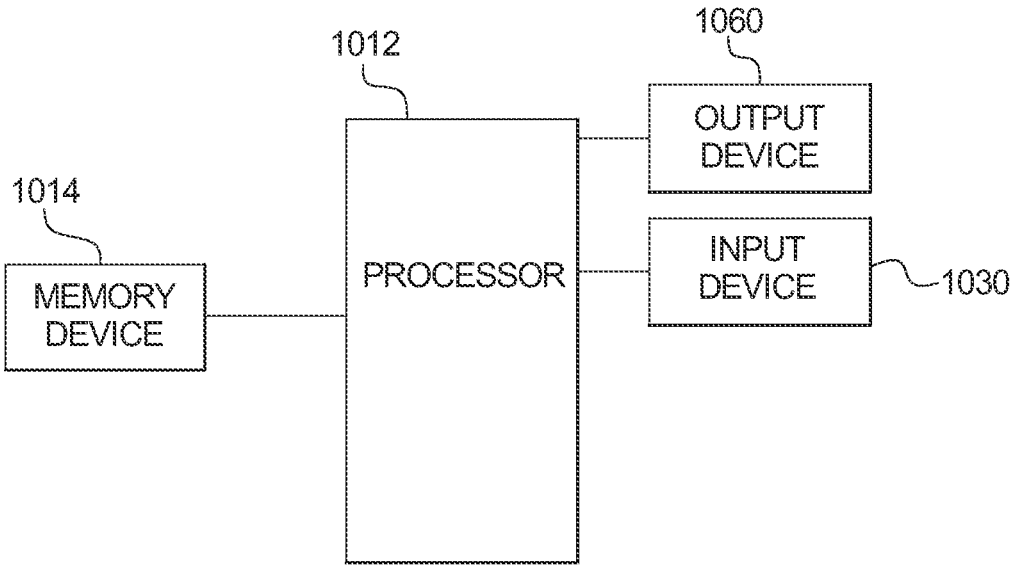
FIG. 5B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 3012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 3014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

Figure 6A:
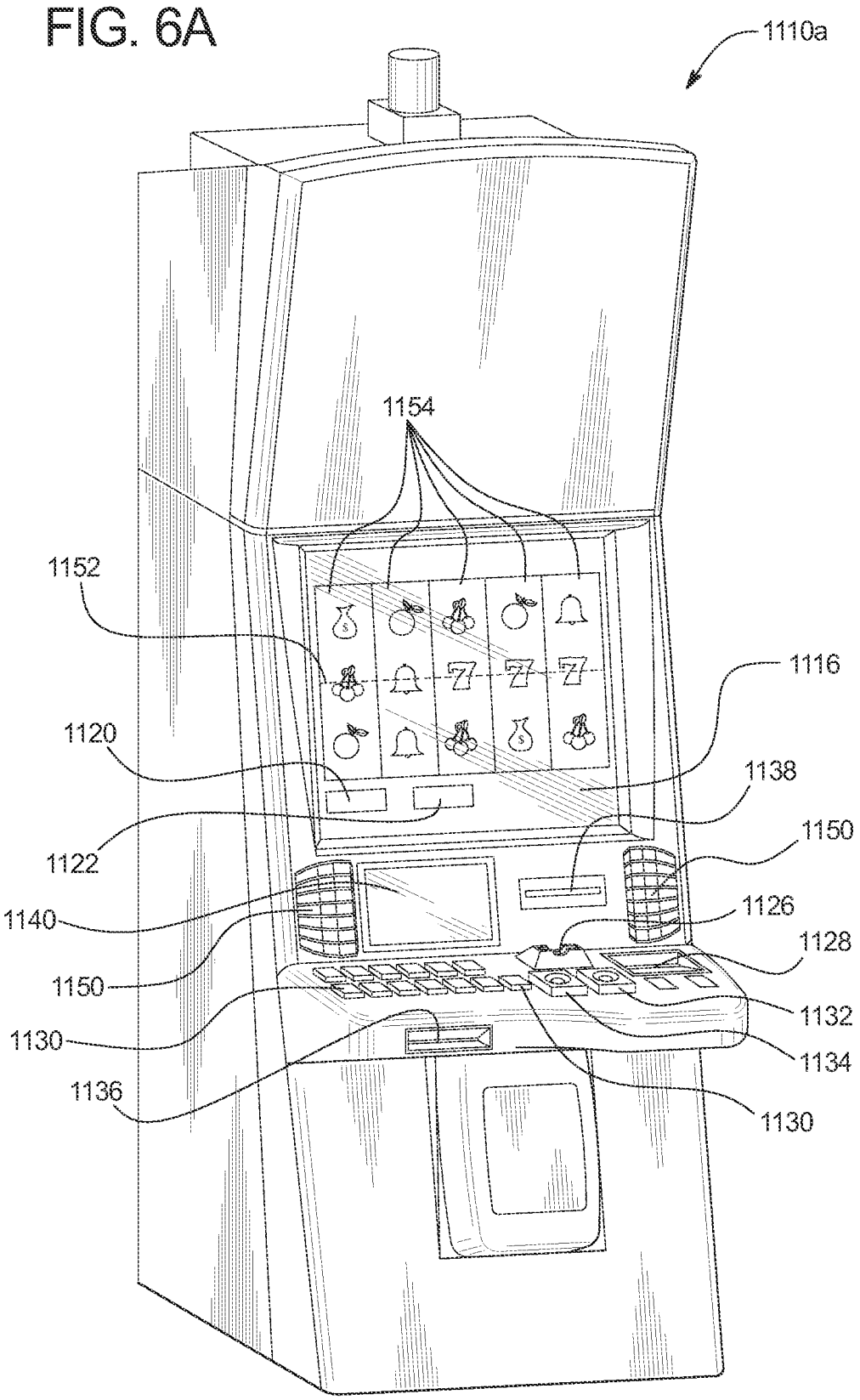
FIGS. 6A and 6B are perspective views of example alternative embodiments of the gaming system of the present disclosure.
Figure 6B:
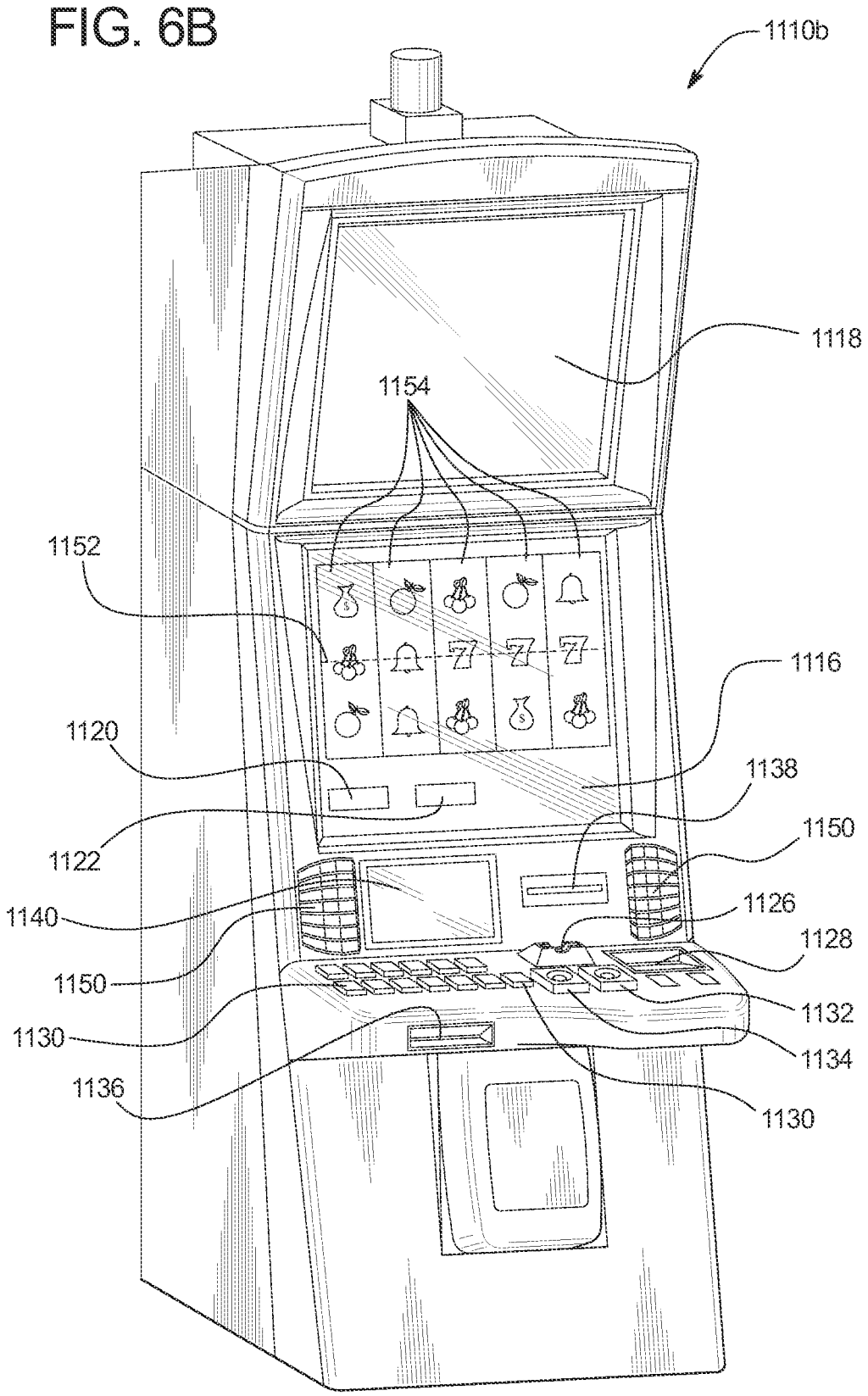

In various embodiments, the EGM includes one or more input devices. The input devices may include any suitable device that enables an input signal to be produced and received by the at least one processor of the EGM. The example EGM illustrated in FIG. 5B includes at least one input device 3030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 6A and 6B illustrate example EGMs that each include the following payment devices: (a) a combined bill and ticket acceptor 3128, and (b) a coin slot 3126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 6A and 6B each include a game play activation device in the form of a game play initiation button 3132. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 3134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 6A and 6B each include a card reader 3138. The card reader is configured to read a player identification card inserted into the card reader.

In various embodiments, the EGM includes one or more output devices. The example EGM illustrated in FIG. 5B includes at least one output device 3060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 6A includes a central display device 3116, a player tracking display 3140, a credit display 3120, and a bet display 3122. The example EGM illustrated in FIG. 6B includes a central display device 3116, an upper display device 3118, a player tracking display 3140, a player tracking display 3140, a credit display 3120, and a bet display 3122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 6A and 6B each include ticket generator 3136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 6A and 6B each include a plurality of speakers 3150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

As generally described above, in certain embodiments, such as the example EGMs illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 6A and 6B include a payline 3152 and a plurality of reels 3154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display areas, the gaming system enables a wager to be placed on a plurality of symbol display areas, which activates those symbol display areas.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention claimed is:

1. An electronic gaming machine comprising:

a payment acceptor;

at least one processor;

at least one display device;

at least one input device; and at least one memory device storing a plurality of instructions which, when executed by the at least one processor, cause the at least one processor to:

responsive to a physical item being received via the payment acceptor, modify a credit balance based, at least in part, on a monetary value associated with the received physical item, the received physical item being any of a ticket associated with the monetary value and a unit of currency;

for a first play of a game:

cause the at least one display device to display a first hand of cards including a first plurality of displayed cards;

enable a player to select, via the at least one input device, a first quantity of the displayed cards of the first hand of cards to save for a subsequent play of the game;

save, in a part of the at least one memory device that retains data after a power failure, each of the selected displayed cards of the first hand of cards;

complete the first play of the game;

determine, based on a paytable, any award associated with the completed first play of the game; and cause the at least one display device to display any determined award, the credit balance being increasable based on any determined award;

for a second play of the game:

cause the at least one display device to display a second hand of cards including a second plurality of displayed cards;

for each of the first quantity of saved cards from the first play of the game, receive one of:

a first player input, via the at least one input device, to use said saved card from the first play of the game for the second play of the game;

a second, different player input, via the at least one input device, to replace said saved card from the first play of the game with a card from the displayed second hand of cards to save for a subsequent play of the game; and a third, different player input, via the at least one input device, to continue to save said saved card from the first play of the game for a subsequent play of the game;

complete the second play of the game;

determine, based on the paytable stored, any award associated with the completed second play of the game; and cause the at least one display device to display any determined award, the credit balance being increasable based on any determined award; and responsive to a cashout input being received, cause an initiation of any payout associated with the credit balance.

2. The electronic gaming machine of claim 1, wherein the first quantity of cards is less than a designated quantity of cards.

3. The electronic gaming machine of claim 1, wherein the designated quantity of cards is a maximum quantity of cards to be saved for each play of the game.

4. The electronic gaming machine of claim 1, wherein the plurality of instructions, when executed by the at least one processor, cause the at least one processor to, prior to causing the first hand of cards to be displayed, randomly select an initial hand of cards from a first virtual deck of cards.

5. The electronic gaming machine of claim 4, wherein the plurality of instructions, when executed by the at least one processor, cause the at least one processor to, prior to causing the second hand of cards to be displayed, randomly select an initial hand of cards from a second virtual deck of cards.

6. The electronic gaming machine of claim 5, wherein the first virtual deck of cards is the same as the second virtual deck of cards.

7. The electronic gaming machine of claim 1, wherein when executed by the at least one processor for the second play of the game, the plurality of instructions cause the at least one processor to randomly select the second hand of cards, and for the displayed second hand of cards, enable the player to select, via the at least one input device, a second quantity of cards from the displayed second hand of cards to save for a subsequent play of the game.

8. The electronic gaming machine of claim 1, wherein when executed by the at least one processor for the completion of a play of the game, the plurality of instructions cause the at least one processor to:

receive a selection, via the at least one input device, of zero, one or a plurality of the cards in the displayed hand to hold;

discard any remaining cards;

replace the discarded cards with replacement cards from a virtual deck of cards for a final hand of cards;

determine a game outcome for the final hand of cards; and determine any award associated with any determined game outcome.

9. The electronic gaming machine of claim 1, wherein for the determination of any award associated with any determined game outcome, if the hand of cards includes any saved cards from a previous play of the game, the determined award is based on a modified paytable.

10. A method of operating an electronic gaming machine, said method comprising:

for a first play of a game following a modification of a credit balance responsive to receipt, via a payment acceptor, of a physical item associated with a monetary value, the received physical item being any of a ticket associated with the monetary value and a unit of currency:

causing a display, by at least one display device, of a first hand of cards including a first plurality of displayed cards;

enabling a player to select a first quantity of the displayed cards of the first hand of cards to save for a subsequent play of the game;

saving, by at least one processor and in association with a memory device that retains data after a power failure, each of the selected displayed cards of the first hand of cards;

completing, by the at least one processor, the first play of the game;

determining, by the at least one processor and based on a paytable, any award associated with the completed first play of the game; and causing a display, by the at least one display device, of any determined award, the credit balance being increasable based on any determined award;

for a second play of the game:

causing a display, by the at least one display device, of a second hand of cards including a second plurality of saved cards;

for each of the first quantity of saved cards from the first play of the game, receiving one of:

a first player input to use said saved card from the first play of the game for the second play of the game;

a second, different player input to replace said saved card from the first play of the game with a card from the displayed second hand of cards to save for a subsequent play of the game; and a third, different player input to save said saved card from the first play of the game for a subsequent play of the game;

completing, by the at least one processor, the second play of the game;

determining, by the at least one processor and based on the paytable, any award associated with the completed second play of the game; and causing a display, by the at least one display device, of any determined award, the credit balance being increasable based on any determined award.

11. The method of claim 10, wherein the first quantity of cards is less than a designated quantity of cards.

12. The method of claim 10, wherein the designated quantity of cards is a maximum quantity of cards to be saved for each play of the game.

13. The method of claim 10, further comprising, prior to causing the first hand of cards to be displayed, randomly selecting, by the at least one processor, an initial hand of cards from a first virtual deck of cards.

14. The method of claim 13, further comprising, prior to causing the second hand of cards to be displayed, randomly selecting, by the at least one processor, an initial hand of cards from a second virtual deck of cards.

15. The method of claim 14, wherein the first virtual deck of cards is the same as the second virtual deck of cards.

16. The method of claim 10, further comprising, for the second play of the game, randomly selecting, by the at least one processor, the second hand of cards, and for the displayed second hand of cards, enabling the player to select a second quantity of cards from the displayed second hand of cards to save for a subsequent play of the game.

17. The method of claim 10, further comprising:

for the completion of a play of the game:

receiving a selection of zero, one or a plurality of the cards in the displayed hand to hold;

discarding, by the at least one processor, the remaining cards;

replacing, by the at least one processor, the discarded cards with replacement cards from a virtual deck of cards for a final hand of cards;

determining, by the at least one processor, a game outcome for the final hand of cards; and determining, by the at least one processor, any award associated with any determined game outcome.

18. The method of claim 10, wherein for the determination of any award associated with any determined game outcome, responsive to the hand of cards including any saved cards from a previous play of the game, the determined award is based on a modified paytable.

19. The method of claim 18, which is executed through a data network.

20. The method of claim 10, wherein the data network is an internet.

21. The method of claim 10, wherein the at least one display device comprises a display device of a mobile device.

22. A gaming system comprising:

a processor;

a memory device which stores a plurality of instructions which, when executed by the processor, cause the processor to:

for a first play of a game:

cause a display, via a display device of a thin-client electronic gaming machine, of a first hand of cards including a first plurality of displayed cards;

receive data associated with a player selection, via the thin-client electronic gaming machine, of a first quantity of the displayed cards of the first hand of cards to save for a subsequent play of the game;

save, in a part of the memory device that retains data after a power failure, each of the selected displayed cards of the first hand of cards;

complete the first play of the game;

determine, based on a paytable, any award associated with the completed first play of the game; and cause a display, via the display device of the thin-client electronic gaming machine, of any determined award;

for a second play of the game:

cause a display, via the display device of the thin-client electronic gaming machine, of a second hand of cards including a second plurality of displayed cards;

for each of the first quantity of saved cards from the first play of the game, receive data associated with one of:

a first input, made via the thin-client electronic gaming machine, to use said saved card from the first play of the game for the second play of the game;

a second, different input, made via the thin-client electronic gaming machine, to replace said saved card from the first play of the game with a card from the displayed second hand of cards to save for a subsequent play of the game; and a third, different input, made via the thin-client electronic gaming machine, to continue to save said saved card from the first play of the game for a subsequent play of the game;

complete the second play of the game;

determine, based on the paytable stored by the at least one memory device, any award associated with the completed second play of the game; and cause a display, via the display device of the thin-client electronic gaming machine, of any determined award.

23. The gaming system of claim 22, wherein the first quantity of cards is less than a designated quantity of cards.

24. The gaming system of claim 22, wherein the designated quantity of cards is a maximum quantity of cards to be saved for each play of the game.

25. The gaming system of claim 22, wherein the plurality of instructions, when executed by the processor, cause the processor to, prior to causing the first hand of cards to be displayed, randomly select an initial hand of cards from a first virtual deck of cards.

26. The gaming system of claim 22, wherein when executed by the processor for the second play of the game, the plurality of instructions cause the processor to randomly select the second hand of cards, and for the displayed second hand of cards, receive data associated with a player selection, via the thin-client electronic gaming machine, of a second quantity of cards from the displayed second hand of cards to save for a subsequent play of the game.

27. The gaming system of claim 22, wherein when executed by the processor for the completion of a play of the game, the plurality of instructions cause the processor to:

receive data associated with a selection, made via the thin-client electronic gaming machine, of zero, one or a plurality of the cards in the displayed hand to hold;

discard any remaining cards;

replace the discarded cards with replacement cards from a virtual deck of cards for a final hand of cards;

determine a game outcome for the final hand of cards; and determine any award associated with any determined game outcome.

28. The gaming system of claim 22, wherein for the determination of any award associated with any determined game outcome, if the hand of cards includes any saved cards from a previous play of the game, the determined award is based on a modified paytable.

29. The gaming system of claim 22, wherein a credit balance is increasable based on any determined award, said credit balance being increasable via an acceptor of a physical item associated with a monetary value, and said credit balance being decreasable responsive to a cashout input.

30. The gaming system of claim 22, wherein the thin-client electronic gaming machine comprises a mobile device.

* * * * *